US005576088A

United States Patent [19]

Ogawa et al.

[11] Patent Number: 5,576,088

[45] Date of Patent: Nov. 19, 1996

[54] INK JET RECORDING SHEET AND PROCESS FOR ITS PRODUCTION

[75] Inventors: Susumu Ogawa; Hideaki Senoh; Masaru Andoh; Hideki Nomura, all of Tokyo, Japan

[73] Assignee: Mitsubishi Paper Mills Limited, Tokyo, Japan

[21] Appl. No.: 417,784

[22] Filed: Apr. 6, 1995

[30] Foreign Application Priority Data

May 19, 1994 [JP] Japan ..... 6-105310
Jun. 22, 1994 [JP] Japan ..... 6-139977
Oct. 20, 1994 [JP] Japan ..... 6-255408

[51] Int. Cl.[6] ..... B41M 5/00

[52] U.S. Cl. ..... 428/327; 428/195; 428/207; 428/211; 428/329; 428/331; 428/341; 428/342

[58] Field of Search ..... 428/195, 537.5, 428/327, 328, 331, 500, 207, 211, 323, 329, 341, 342 R

[56] References Cited

U.S. PATENT DOCUMENTS 5,472,773 12/1995 Misuda et al. ..... 428/195

FOREIGN PATENT DOCUMENTS 7-89220 4/1995 Japan .

*Primary Examiner*—Pamela R. Schwartz
*Attorney, Agent, or Firm*—Oblon, Spivak, McClelland, Maier & Neustadt, P.C.

[57] ABSTRACT

An ink jet recording sheet comprising a support, at least one ink-receiving layer formed on the support, and a gloss-providing layer formed on the ink-receiving layer, said ink-receiving layer consisting essentially of a pigment and a binder, and said gloss-providing layer consisting essentially of a pigment and a synthetic polymer latex as a binder and having a glossy surface with a 75° specular gloss of at least 25% as stipulated in JIS-Z8741, wherein at least 70 parts by weight in 100 parts by weight of the pigment in the gloss-providing layer are constituted by colloidal particles having an average particle size of at most 300 nm.

20 Claims, No Drawings

INK JET RECORDING SHEET AND PROCESS FOR ITS PRODUCTION

BACKGROUND OF THE INVENTION

1. Field of the Invention

The present invention relates to an ink jet recording sheet for recording with a water-color ink and a process for its production. Particularly, it relates to an ink jet recording sheet which has high glossiness comparable to commercially available cast coated paper or art coated paper and which is excellent in ink absorptivity and capable of presenting a high printed image density, and a process for its production.

2. Discussion of Background

An ink jet recording system is a system whereby fine droplets of ink are jetted and deposited on a recording sheet such as a paper sheet to record images or letters by various operational principles, and it has features such as high speed and no noise and such that multicoloring is easy, flexibility for various recording patterns is high, and no development or fixing is required. Such an ink jet recording system has been used for various applications as a recording apparatus for various patterns including Chinese characters and for color images. Further, with respect to an image formed by a multi-color ink jet system, it is possible to obtain a record comparable to a printed image by a multi-color photographic system by plate-making system. Further, in a case where the number of copies is relatively small, the ink jet recording system is inexpensive as compared with the photographic system, and it is accordingly widely applied even to the full color image recording field.

The recording sheet to be used for such an ink jet recording system is required to satisfy requirements that the printed dot density must be high, the color must be bright and clear, absorption of the ink must be swift so that even if printed dots are overlaid one on another, the ink will not run or blot, diffusion of the printed dots in a transverse direction must not be more than necessary, and the peripheries of the printed dots must be smooth and must not be blurred.

To satisfy such requirements, some proposals have been made heretofore. For example, Japanese Unexamined Patent Publication No. 53012/1977 discloses an ink jet recording sheet prepared by wetting base paper having a low sizing degree with a coating material for surface treatment. Further, Japanese Unexamined Patent Publication No. 5830/1980 discloses an ink jet recording sheet having an ink-absorbing coating layer formed on the surface of a support. Japanese Unexamined Patent Publications No. 51583/1980 and No. 157/1981 disclose embodiments in which non-glue silica powder is used as a pigment in a coating layer. Further, Japanese Unexamined Patent Publication No. 11829/1980 discloses an embodiment of coated paper of a double layered structure differing in the ink absorbing rate.

In an ink jet recording sheet, it is common to provide an ink-receiving layer employing a porous pigment and having an ink absorbing property to control the color effect and the definition which are decisive for the image quality and thereby to improve color reproducibility and image reproducibility. The ink-receiving layer having ink absorptivity is required to have many voids in the ink-receiving layer to absorb and maintain ink. However, the ink-receiving layer having many voids has difficulties that incident light to the ink-receiving layer is likely to be scattered and its transmittance tends to be prevented, whereby the ink-receiving layer tends to be opaque, and it tends to be difficult for light to reach the ink penetrated into voids, whereby the image tends to be whitened, and the color reproducibility and the color density tend to be low. The ink-receiving layer having many voids tends to have a porous surface, whereby high gloss can hardly be expected.

With respect to an ink jet recording sheet having high gloss, for example, Japanese Unexamined Patent Publication No. 197285/1986 proposes a method wherein a porous ink-receiving layer is formed on a transparent support, so that an image formed on the ink-receiving layer can be observed from the support side. Japanese Unexamined Patent Publication No. 215081/1991 proposes a method wherein a dye adsorbing layer composed of a porous alumina hydrate and a solvent absorbing layer composed of a porous fine powdery silica are sequentially laminated on a transparent substrate, so that an image formed on the dye adsorbing layer can be observed from the support side. However, these methods have drawbacks that in printing the image, it is necessary to conduct image treatment to obtain a mirror image, and the support to be used is limited to the one having transparency.

Japanese Unexamined Patent Publication No. 113986/1990 discloses a method of treating with an aqueous solution containing a cationic polymer electrolyte, followed by casting, and Japanese Unexamined Patent Publication No. 274587/1990 proposes a method wherein using colloidal silica for the improvement of gloss, treatment with an aqueous solution containing a cationic polymer electrolyte, is followed by casting. However, use of a cationic polymer electrolyte has a drawback that the cationic polymer electrolyte present on the surface when printed, will dissolve again in the ink, whereby the surface contour at the printed portion is roughened, whereby the gloss or the definition of the image at the printed portion tends to deteriorate.

Recording sheets or films are available wherein a resin capable of absorbing ink by dissolution and swelling, is coated for the purpose of imparting gloss. However, such recording sheets or films of the type to let the ink be absorbed by dissolution and swelling of the resin have problems that absorption and drying of the ink are slow, and stains or smudges are likely to result due to ink transfer, although gloss can be obtained.

For the treatment to impart gloss, it is common to employ a method wherein by means of a calender apparatus such as super calender or gloss calender, a coated sheet is passed between rolls to which a temperature and a pressure are applied, to smooth the coating layer surface. However, if calender treatment is carried out under a high linear load for the purpose of imparting gloss, although the gloss will be improved, voids in the coating layer will decrease, whereby there will be problems that absorption of ink tends to be slow, and due to inadequate absorption capacity, ink is likely to overflow. Accordingly, for the calender treatment, conditions have to be selected within a range permitted by the ink absorption capacity, and with the presently available techniques, it is difficult to attain gloss and absorption of ink simultaneously.

On the other hand, in recent years, ink jet recording sheets have found their application also to labels and tags. In the process for preparing such labels or tags, the sheets are bent or folded. Accordingly, they are required to have not only the surface strength but also flexural strength. Further, an ink jet recording apparatus is used in a manner similar to a widely used copying machine, and after copying, the recording sheets are likely to be filed or bound into a book, whereby they are required to have adequate folding strength. If the folding strength is inadequate, the folded portion tends to peel and loses the ink jet recording properties. Thus, it has become necessary to secure not only the coat strength but also the folding strength also for ink jet recording sheets.

Further, the ink jet recording system provides good definition and color effect at a level of personal computers, and it has been made possible to quickly obtain even a complicated image relatively simply. However, conventional ink jet recording sheets are poor in the gloss of sheet as compared with printing paper or photographic paper, whereby it has been difficult to use them in the field where gloss is desired e.g. in the field of posters or stickers, in view of their poor gloss. However, there is an increasing demand for recording media whereby convenience of the ink jet recording system can be utilized by overcoming the mutually opposing relation of the ink absorptivity and the gloss.

SUMMARY OF THE INVENTION

It is an object of the present invention to provide an ink jet recording sheet which, when printed with a water-color ink, is excellent in ink absorptivity, has a high printed image density and gloss, is excellent in the color reproducibility and the image reproducibility and further has folding strength secured, particularly an ink jet recording sheet for full color recording, for which gloss at a level of commercially available cast coating paper used for offset printing or as labels or tags, is desired. Another object of the present invention is to provide a process for producing such an ink jet recording sheet.

The present inventors have conducted an extensive research with respect to ink jet recording sheets and as a result, has arrived at the ink jet recording sheet of the present invention and a process for its production.

Thus, the present invention provides an ink jet recording sheet comprising a support, at least one ink-receiving layer formed on the support, and a gloss-providing layer formed on the ink-receiving layer, said ink-receiving layer consisting essentially of a pigment and a binder, and said gloss-providing layer consisting essentially of a pigment and a synthetic polymer latex as a binder and having a glossy surface with a 75° specular gloss of at least 25% as stipulated in JIS-Z8741, wherein at least 70 parts by weight in 100 parts by weight of the pigment in the gloss-providing layer are constituted by colloidal particles having an average particle size of at most 300 nm.

In the ink jet recording sheet of the present invention, it is preferred that at least 90 parts by weight in 100 parts by weight of the pigment in the gloss-providing layer are constituted by the colloidal particles. More preferably, the pigment in the gloss-providing layer is entirely constituted by the colloidal particles. The colloidal particles preferably have an average particle size of at most 100 nm. The colloidal particles are preferably at least one member selected from the group consisting of colloidal silica, polystyrene-type organic particles, porous amorphous silica.alumina and acrylic organic particles. Cationic colloidal particles are particularly preferred. Also preferred are colloidal particles comprising organic particles and colloidal silica in a weight ratio of organic particles/colloidal silica of from 40/60 to 90/10.

The binder for the gloss-providing layer is preferably a synthetic polymer latex having an average particle size of at most 150 nm, preferably at most 100 nm. The synthetic polymer latex preferably has a glass transition temperature of at most +30° C.

The binder of the gloss-providing layer is preferably a colloidal silica composite emulsion. The gloss-providing layer preferably contains an ampholite.

In the ink jet recording sheet of the present invention, the gloss-providing layer preferably contains smectite in an amount of from 0.5 to 10 parts by weight per 100 parts by weight of the colloidal particles.

The pigment in the ink-receiving layer adjacent to the gloss-providing layer is preferably a pigment having at least 30 vol % of particles having a particle size of at most 1.0 μm. The pigment in the ink-receiving layer adjacent to the gloss-providing layer is preferably cationic colloidal particles.

The ink-receiving layer adjacent to the gloss-providing layer preferably contains a cationic fixing agent.

The 75° specular gloss, as stipulated in JIS-Z8741, of the gloss-providing layer is preferably at least 40%, more preferably at least 55%, still more preferably at least 70%, and most preferably at least 80%.

The present invention also provides a process for producing an ink jet recording sheet, which comprises forming on a support at least one ink-receiving layer consisting essentially of a pigment and a binder, then coating on the ink-receiving layer a coating composition consisting essentially of a pigment and a binder, wherein at least 70 parts by weight in 100 parts by weight of the pigment in the coating composition are constituted by colloidal particles having an average particle size of at most 300 nm, to form a gloss-providing layer and press-contacting a heated specular roll directly to the surface of the gloss-providing layer for specular finish while the surface of the gloss-providing layer is still in a wet state.

Further, the present invention provides a process for producing an ink jet recording sheet, which comprises forming on a substrate at least one ink-receiving layer consisting essentially of a pigment and a binder, then coating on the ink-receiving layer a coating composition consisting essentially of a pigment and a binder, wherein at least 70 parts by weight in 100 parts by weight of the pigment in the coating composition are constituted by colloidal particles having an average particle size of at most 300 nm, to form a gloss-providing layer drying the gloss-providing layer, then re-wetting the surface of the gloss-providing layer with a fluid consisting essentially of water, and press-contacting a heated specular roll to the surface of the gloss-providing layer for specular finish while the coated surface is still in a wet state.

Still further, the present invention provides a process for producing an ink jet recording sheet, which comprises forming on a substrate at least one ink-receiving layer consisting essentially of a pigment and a binder, then coating on the ink-receiving layer a coating composition consisting essentially of a pigment and a binder, wherein at least 70 parts by weight in 100 parts by weight of the pigment in the coating composition are constituted by colloidal particles having an average particle size of at most 300 nm, to form a gloss-providing layer, solidifying the surface of the gloss-providing layer by using an infrared dryer, then rewetting the surface of the gloss-providing layer with a fluid consisting essentially of water, and press-contacting a heated specular roll to the surface of the gloss-providing layer for specular finish within 5 minutes of the re-wetting.

DETAILED DESCRIPTION OF THE PREFERRED EMBODIMENTS

Now, the present invention will be described in detail with reference to the preferred embodiments.

In order to obtain good ink absorptivity and dye-fixing property which are the features of ink jet recording sheets, it is common to employ a method wherein a coating layer composed mainly of a porous pigment is provided. However, since such a pigment is secondary or tertiary particles having large particle sizes, it is difficult to provide sensible gloss. Even if calender treatment is carried out under a high linear load at a high temperature for the purpose of improvement in smoothness, not only the gloss intended in the present invention is not be obtained, but also the ink absorptivity becomes poor due to decrease in voids, and thus the features of an ink jet recording sheet get lost.

Since use of a pigment having a small particle size improves gloss, application of colloidal particles to a composition for a coating layer was attempted. However, when a coating composition composed mainly of colloidal particles is coated directly on a support, since the coating layer has a small ink absorption capacity, there is a problem that ink tends to overflow. Further, when the support is composed mainly of wood pulp, diffusion of ink along the sides of the pulp fibers causes feathering, penetration of ink to the back of the recording sheet causes striking-through, and the printed image density is decreased. In addition, the desired gloss can not be attained.

Cast treatment is the treatment wherein the surface conditions of a specular roll are transferred to the surface of a coating layer so that a specular gloss is imparted to a surface of the coating layer. However, it was found that when the coating layer of an ink jet recording sheet as the same composition as that of commercially available cast coated paper, which is composed mainly of a pigment such as kaolin or calcium carbonate, is subjected to cast treatment, the resulting recording sheet has problems in color effect and definition which are decisive for the image quality. It was also found that with a coating layer composed mainly of a porous pigment, the glossiness intended in the present invention can not be attained. From the fact that the glossiness is improved by use of smaller particles, the cast treatment of a coating layer in which colloidal particles and a porous pigment are used in combination, may be conceivable. However, even by such cast treatment, the intended glossiness can not be attained. If the amount of the colloidal particles is increased for the purpose of improvement in the glossiness, the ink absorptivity becomes poor, thus the objects of the present invention can not be attained.

On the basis of this knowledge, it has been found that by providing a ink-receiving layer on a support and then coating a coating composition composed mainly of colloidal particles on the ink-receiving layer to form a gloss-providing layer, the above problems can be solved, and the gloss is provided, and the characteristics attributable to the definition and the color effect of the ink-receiving layer are obtained.

Namely, since the ink jet recording sheet of the present invention has a double-layered coating structure on its printing surface, which is composed of at least one ink-receiving layer and a gloss-providing layer, it is possible for the recording sheet of the present invention to have mutually opposing characteristics, i.e., an improved gloss and a secured ink-absorptivity, simultaneously.

When a water-color ink is deposited on the recording surface of the ink jet recording sheet of the present invention, the water-color ink penetrates through the gloss-providing layer and is rapidly absorbed in the ink-receiving layer provided under the gloss-providing layer. Namely, the gloss-providing layer has a function to have most of the ink penetrate, and the ink-receiving layer has functions such as ink absorptivity and dye-fixing property. Thus, by adopting such a double-layered structure wherein the two layers have different functions, the objects of the present invention can be accomplished.

The support to be used in the present invention may be base paper produced by various apparatus such as a Fourdrinier paper machine, a cylinder paper machine or a twin wire paper machine from a mixture prepared by mixing its main components, i.e., a conventional pigment and a wood pulp including, for example, a chemical pulp such as LBKP or NBKP, a mechanical pulp such as GP, PGW, RMP, TMP, CTMP, CMP or CGP, and a waste paper pulp such as DIP, with at least one of various additives including a binder, a sizing agent, a fixing agent, a yield-improving agent, a cationic agent and a paper strength-increasing agent. Further, it may be base paper which has been size-pressed by using starch or polyvinyl alcohol or has an anchor coat layer thereon, a coated paper having a coating layer provided on such base paper, such as art paper, coated paper or cast coated paper. On such base paper or coated paper, an ink-receiving layer may be directly formed. Otherwise, in order to control the flatness, a calendering apparatus such as a machine calender, a TG calender or a soft calender, may be employed. The weight by unit area of the support is usually from 40 to 300 g/m$^2$. However, there is no restriction to the weight by unit area of the support.

When the gloss-providing layer is subjected to cast treatment, the support is required to have gas or air permeability in order to transfer the vapor which generates upon the cast treatment to the back of the recording sheet and dry the gloss-providing layer. The air or gas permeability of the support is a critical factor which decides the releasability of the gloss-providing layer from a specular roll. Therefore, although the support is usually base paper, it may be a sheet of fibers of a synthetic resin such as polyethylene, polypropylene, polyester, rayon or polyurethane, as long as it has air or gas permeability.

The ink-receiving layer in the present invention consists essentially of a pigment and a binder. As the pigment to be used for the ink-receiving layer, at least one conventional white pigment can be employed. For example, as the pigment, a white inorganic pigment such as light calcium carbonate, heavy calcium carbonate, magnesium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, alumina, colloidal alumina, pseudo boehmite, aluminum hydroxide, lithopone, zeolite, hydrolyzed halloysite or magnesium hydroxide, or an organic pigment such as a styrene-type plastic pigment, an acrylic plastic pigment, polyethylene, microcapsules, a urea resin or a melamine resin, may be mentioned.

In order to obtain an ink jet recording sheet having a high ink absorptivity, it is referred that the pigment in the ink-receiving layer adjacent to the gloss-providing layer is a pigment having at least 30 vol % of particles having a particle size of at least 1.0 μm.

The ink absorptivity depends on the coating structure of the ink-receiving layer, and the coating structure further depends on the particle size of the pigment used in the ink-receiving layer. The smaller the particle size, the smaller the diameters of the voids formed between the particles of the pigment, whereby the higher the ink absorptivity. It is possible to secure a sufficient ink absorptivity by forming the ink-receiving layer in the present invention from the coating composition composed mainly of a porous pigment which is agglomerates or aggregates of primary particles having diameters of from several nm to hundreds nm.

Of course, the porous pigment having at least 30 vol % of particles having a particle size of at most 1.0 μm is restricted to those mentioned above as the pigment to be used for the ink-receiving layer. Such a pigment is preferably used in an amount of at least 70 wt % of the total pigment in the ink-receiving layer.

Further, among the above-mentioned pigments to be used in the ink-receiving layer in the present invention, those which are cationic colloidal particles are preferred, since cationic colloidal particles provide a function of fixing an ink to the ink-receiving layer, thereby the printed image density and water resistance improve. It is possible to provide ink-fixing property by incorporating cationic colloidal particles into the ink-receiving layer in an amount of at least 0.5 $g/m^2$. Such cationic colloidal particles may be used in combination with a conventional pigment. The coated amount of cationic colloidal particles affects the feeling of the resulting ink jet recording sheet. In the case where a feeling like coated paper is desired, such a feeling is attained by increasing the amount of cationic colloidal particles in the ink-receiving layer. In the case where the coated amount is decreased to obtain a feeling like base paper or general paper or in the case where it is desired to capture specific dye components in inks in various colors for the purpose of control of the color effect, such cationic colloidal particles may be used in combination with a cationic dye-fixing agent.

The ink-receiving layer in the present invention contains a water-soluble binder. The binder provides adhesiveness to the interface between the gloss-providing layer and the ink-receiving layer and secures the adhesiveness at the interface more firmly. Although the mechanism of emergence of the adhesiveness is unclear, it seems that since a coating composition for a gloss-providing layer usually contains water as a dispersing medium, when a gloss-providing layer is coated on the ink-receiving layer, the dispersing medium in the gloss-providing layer penetrates the ink-receiving layer dissolving a water-soluble binder in the ink-receiving layer, whereby the ink-receiving layer adheres to the gloss-providing layer, and the strong adhesiveness at their interface is secured.

The water-soluble binder to be used in the ink-receiving layer in the present invention may, for example, be a starch derivative such as oxidized starch, a etherified starch or phosphate starch; a cellulose derivative such as carboxymethyl cellulose or hydroxymethyl cellulose; casein, gelatin, soybean protein, polyvinyl alcohol or a derivative thereof; polyvinyl pyrrolidone, a maleic anhydride resin or a conjugated diene-type copolymer latex such as a styrene-butadiene copolymer or a methyl methacrylate-butadiene copolymer; acrylic polymer latex such as a polymer or copolymer of an acrylic acid ester or a methacrylic acid ester; a vinyl-type polymer latex such as an ethylene-vinyl acetate copolymer; a functional group-modified polymer latex of such a various polymer with a monomer containing a functional group such as a carboxyl group; an aqueous adhesive such as a thermosetting synthetic resin such as a melamine resin or a urea resin; a polymer or copolymer resin of an acrylic acid ester or a methacrylic acid ester such as a polymethyl methacrylate; or a synthetic resin-type binder such as a polyurethane resin, an unsaturated polyester resin, a vinyl chloride-vinyl acetate copolymer, polyvinyl butyral or an alkyd resin.

The amount of the binder in the ink-receiving layer is from 3 to 70 parts by weight, preferably from 5 to 50 parts by weight per 100 parts by weight of the pigment. If the amount of the binder is less than 3 parts by weight, the strength of the ink-receiving layer will be insufficient. If the amount is more than 70 parts by weight, the ink absorptivity will be poor.

It is preferred that the ink-receiving layer further contains a cationic dye-fixing agent which is a secondary amine, a tertiary amine or a quaternary ammonium salt. Since such a cationic dye-fixing agent forms an insoluble salt together with a water-soluble direct or acid dye which is a dye component in ink, by binding to sulfonic, carboxyl or amino groups of the dye, when such a cationic dye-fixing agent is incorporated into the ink-receiving layer, the dye in ink is captured in the ink-receiving layer, whereby the color effect improves. Further, the formation of the insoluble salt prevents the ink from running or blotting, when water is dropped thereon or absorbed thereby. Therefore, water resistance improves.

Further, to the ink-receiving layer, a dye-fixing agent, a pigment dispersant, a thickener, a fluidity-improving agent, a defoaming agent, a foam-suppressing agent, a release agent, a blowing agent, a penetrating agent, a coloring dye, a coloring pigment, a fluorescent brightener, an ultraviolet absorber, an anti-oxidant, a preservative, an ash-preventing agent, a waterproofing agent, a wet-strength agent or a dry strength agent may suitable be added as additives.

The ink-receiving layer is provided so that the coated amount would be at least 1 $g/m^2$, although it varies depending on required gloss and ink absorptivity and type of the support. It is possible to provide a predetermined amount of the ink-receiving layer in two coating steps. In such a case, the gloss improves as compared with the case where the same amount of the ink-receiving layer is formed in one coating step. It is also possible to provide at least one coating layer between the ink-receiving layer and the support.

The gloss-providing layer in the present invention is formed from a coating composition composed mainly of pigment and a binder.

As the pigment to be used for the gloss-providing layer, a white inorganic pigment such as light calcium carbonate, heavy calcium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, colloidal alumina, pseudo boehmite, aluminum hydroxide, alumina, lithopone, zeolite, hydrolyzed halloysite, magnesium hydroxide, or magnesium hydroxide, or an organic pigment such as a styrene-type plastic pigment, an acrylic plastic pigment, polyethylene, microcapsules, a urea resin or a melamine resin, may, for example, be mentioned.

In the gloss-providing layer in the present invention, at lest 70 parts by weight in 100 parts by weight of the pigment are constituted by colloidal particles.

The colloidal particles to be used in the present invention are inorganic or organic particles which are suspended and dispersed in water in a colloidal state and have an average particle size measured by a dynamic scattering method of at most 300 nm. As the colloidal particles, inorganic particles such as colloidal silica, an alumina sol including boehmite and pseudo boehmite, colloidal alumina, cationic aluminum oxide or its hydrate or particles disclosed in Japanese Examined Patent Publication No. 26959/1972 which are colloidal silica particles having alumina coating on the surfaces, or organic particles such as particles of polystyrene, methyl methacrylate, a styrene-butadiene copolymer, a methyl methacrylate-butadiene copolymer, a copolymer of an acrylic acid ester or a methacrylic acid ester, microcapsules, a urea resin, a melamine resin, may, for example, be mentioned. Among them, two or more may be used in combination.

The average particle size of the colloidal particles is preferably at most 300 nm, more preferably at most 200 nm, from the view of provision of the gloss. If the average particle size exceeds 300 nm, the gloss-providing layer becomes opaque, and the printed image density might decrease to an unacceptable degree, although it depends on the required color effect.

Not only the printed image density of the ink-receiving layer, but also transparency of the gloss-providing layer is important to the printed image density which is decisive for the image quality recorded by an ink jet recording system. In order to obtain an image with a good printed image density, it is preferred that the average particle size of the colloidal particles in a coating composition for the gloss-providing layer is at most 300 nm, preferably 200 nm.

In the gloss-providing layer in the present invention, it is possible to use at least one conventional white pigment other than the colloidal particles in combination with the colloidal particles. Since such a white pigment usually has a large particle size and makes the gloss-providing layer opaque, it is necessary that the weight ratio of the colloidal particles/the white pigment other than the colloidal particles is at least 80/20, preferably at least 90/10, although it depends on the particle size of the white pigment.

As the colloidal particles to be used for the gloss-providing layer in the present invention, the porous amorphous silica-alumina having an average particle size of at most 200 nm, since the printed water-color ink can be absorbed and fixed in the gloss-providing layer, whereby the printed image density can be increased. The colloidal particles of the porous amorphous silica.alumina is supplied in a suspended and dispersed form and takes the form of porous secondary or higher particles in which primary particles having particle sizes of at most several nm, preferably at most 1 nm form networks. The weight ratio of silica/alumina is preferably at most 90/10. If the weight ratio is more than 90/10, the ink absorptivity of the gloss-providing layer will be poor. When such a porous amorphous silica.alumina constitutes the gloss-providing layer in combination with other pigments, the porous amorphous silica.alumina is used in an amount of at least 5 parts by weight, preferably at least 10 parts by weight per 100 parts by weight of the pigment in the gloss-providing layer.

As the colloidal particles to be used for the gloss-providing layer in the present invention, cationic colloidal particles are more preferred. Cationic colloidal particles are particles which are suspended and dispersed in water in a colloidal state, have an average particle size measured by a dynamic light scattering method of at most 300 nm in a colloidal state, and have positively charged surfaces. As cationic colloidal particles, an alumina sol such as boehmite or pseudo boehmite, colloidal alumina or particles disclosed in Japanese Examined Patent Publication No. 26959/1972 which are particles of colloidal silica having surfaces coated with alumina may, for example, be mentioned. If the average particle size exceeds 300 nm, the ink fixing property becomes poor due to decrease in the surface area of the colloidal particles, therefore, it will be necessary to increase the coated amount of the gloss-providing layer.

Since the cationic colloidal particles have positively charged surfaces, they can form an insoluble salt together with a direct dye or a water-soluble acid dye as a dye component in ink by the electrical interaction between the cationic colloidal particles and sulfonic, carboxylic and amino groups in the dye, to fix the dye component in the gloss-providing layer. Since the colloidal particles themselves do not have absorption capacity enough to absorb the solvent component in ink, the solvent component penetrates through the gloss-providing layer to the ink-receiving layer. Even if in the ink-receiving layer, the solvent component defuses along its surface or penetrates deep, the solvent component does not affects the color effects and the definition due to absence of the dye component. Therefore, voids as many as required to absorb and fix the ink simultaneously are no longer necessary.

It is also preferred that the colloidal particles to be used for the gloss-providing layer in the present invention comprise organic particles and colloidal silica for further improvement in the gloss of the ink jet recording sheet.

It is possible to improve the gloss of the ink jet recoding sheet of the present invention to a specular gloss by subjecting it to cast treatment, in which the ink jet recording sheet is press-contacted to a heated specular roll. In the case of cast treatment, use of organic particles, which are plasticized on heating, in the gloss-providing layer improves the gloss. However, plasticization of the organic particles increases the adhesiveness to the specular roll and thereby tends to lower the releasability from the roll. Consequently, in some cases, the coating composition for the gloss-providing layer adheres to the roll at the time of releasing, and it is difficult to release the gloss-providing layer from the roll.

The lowered releasability from the roll results in a poor operating efficiency at the time of production. Besides, if the coating composition adheres to the roll, the gloss-providing layer obtained after the cast treatment will have a damaged surface, which gives poor gloss at the damaged portions as well as an even printing, thereby the resulting ink jet recording sheet will be of low quality.

Further, such organic particles have a problem that if the temperature of the specular roll at the time of the cast treatment is higher than the glass transition temperature of the organic particles, the organic particles adhere to one another, and the function to have an ink penetrate is impaired. Particularly, they have a problem that if the temperature is higher than the minimum film-forming temperature of the organic particles, the function to have an ink penetrate and the ink absorptivity are lost due to their fusion.

Accordingly, in the case where a coating composition containing organic particles is subjected to cast treatment, it is necessary to carry out cast treatment under such conditions determined by taking the releasability and the ink penetrability into consideration. However, the combined use of organic particles and colloidal silica as the colloidal particles makes it possible to secure an improved gloss attributable to the organic particles while improving the releasability. With respect to the releasability, it seems that colloidal silica reduces the adhesiveness to a specular roll, and with respect to the ink penetrability, it seems that colloidal silica moderates the adhesion and the fusion of the organic particles. Although the amounts of organic particles and colloidal silica to be used vary depending on types of organic particles and colloidal silica, the preferable organic particle/colloidal silica weight ratio is from 40/60 to 90/10. If the weight ratio is smaller than 40/60, improvement of the gloss attributable to plasticization of the organic pigment can hardly be attained. If the weight ratio is larger than 90/10, no appreciable effect on the releasability and the ink penetrability is obtained.

As the binder used for the gloss-providing layer in the present invention, a synthetic polymer latex is used. By the use of a synthetic polymer latex as the binder, it is possible to obtain an ink jet recording sheet of a high printed image density and a high gloss.

As the synthetic polymer latex to be used for the gloss-providing layer in the present invention, a conjugated diene-type copolymer latex such as a styrene-butadiene copolymer or a methyl methacrylate-butadiene copolymer; an acrylic polymer latex such as a polymer or copolymer of an acrylic acid ester or a methacrylic acid ester; a vinyl-type polymer latex such as an ethylene-vinyl acetate copolymer; or a functional group-modified polymer latex of such a various polymer with a monomer containing a functional group such as a carboxyl group may, for example, be mentioned. Among them, those having average particle sizes of at most 100 nm are preferred, since they can prevent the gloss-providing layer from becoming opaque. In the case where the gloss-providing layer is not subjected to cast treatment, the amount of the latex to be used is preferably from 2 to 30 parts by weight per 100 parts by weight of the pigment, from the viewpoints of assurance of the folding strength and the ink absorbing rate. If the amount exceeds 30 parts by weight, penetration of an ink into the ink-receiving layer will be slow, thereby overflow of an ink can occur, depending on the type of ink jet apparatus. In the case where the gloss-providing layer is subjected to cast treatment, the amount of the synthetic polymer latex in the gloss-providing layer is from 5 to 70 parts by weight per 100 parts by weight of the colloidal particles. If the amount is smaller than 5 parts by weight, a problem that a coating layer is peeled by a specular roll will arise at the time of treatment by a cast coating method. On the other hand, the amount larger than 70 parts by weight will result in a poor ink penetrability and an opaque gloss-providing layer, which can come to problem depending on the type of ink jet recording apparatus and the required level of printed image density.

The glass transition temperature of the synthetic polymer latex is at most +30° C., preferably from −50° to +30° C. The glass transition temperature is a parameter indicating the flexibility of the synthetic polymer latex. The glass transition temperature is preferred to be at most +30° C., since a flexible coating layer is preferred in view of folding strength. If the glass transition temperature is higher than +30° C. it is necessary to increase the amount of the synthetic polymer latex. On the other hand, since an ink jet recording apparatus feeds layered sheets sheet by sheet, if the glass transition temperature is low, the sheets will be sticky and cause blocking, the ink jet recording apparatus will be jammed with sheets or feed a couple of sheets at once. Therefore, the glass transition temperature is preferred to be at least −50° C. Further, in the case where the gloss-providing layer is subjected to cast treatment, since the glass transition temperature of the synthetic polymer latex is associated with the adhesiveness to a specular roll and thereby affects the releasability from the roll, the glass transition temperature is preferred to be at least −30° C.

It is preferred that the synthetic polymer latex is a colloidal silica composite emulsion, since the printed image density is further improved and the ink penetrability of the gloss-providing layer is improved.

The colloidal silica composite emulsion to be used in the present invention is an emulsion of particles which have cores composed mainly of the above-mentioned polymer or copolymer and have colloidal silica outside the cores. The colloidal silica composite emulsion can be obtained by polymerizing a monomer having an ethylenic unsaturated bond in the presence of the colloidal silica disclosed in Japanese Unexamined Patent Publications No. 71316/1984 and No. 127371/1985 by a conventional emulsion polymerization method. The particle size of the colloidal silica to be used for the colloidal silica composite emulsion is preferably less than 40 nm. If the particle size exceeds 40 nm, the resulting composite will have a particle size larger than 100 nm, and the gloss-providing layer will become opaque. Therefore, the printed image density will be low.

With respect to the amount of colloidal silica to be used for the colloidal silica composite emulsion, the monomer/colloidal silica weight ratio is preferably from 90/10 to 40/60. If the weight ratio is larger than 90/10, the printed image density can hardly be improved. If the weight ratio is smaller than 40/60, it is necessary to increase the amount of the colloidal silica composite emulsion in order to secure the folding strength. Even if colloidal silica having a particle size of less than 40 nm and a synthetic polymer latex are merely mixed to prepare the gloss-providing layer, the resulting gloss-providing layer will not have properties comparable to that prepared by using the composite emulsion. In such a case, since particles of the colloidal silica aggregate into particles having a large appearent particle size, the resulting gloss-providing layer will be opaque, and the printed image density will be low. The colloidal silica composite emulsion may be used in combination with the above-mentioned synthetic polymer latex, depending on the type of ink jet recording apparatus or the level of required ink absorptivity.

The gloss-providing layer in the present invention is formed from a coating composition composed mainly of colloidal particles and a synthetic polymer latex, and contains the synthetic polymer latex preferably in an amount of from 2 to 30 parts by weight per parts by weight of the colloidal particles, in the case where the gloss-providing layer is not subjected to cast treatment, or from 5 to 70 parts by weight in the case where the gloss-providing layer is subjected to cast treatment. If the amount of the latex is larger than 30 parts by weight, penetration of ink into the ink-receiving layer will be slow, and thereby overflow of an ink occurs in some types of ink jet recording apparatus. The amount of the coating composition to be coated is at least 2 $g/m^2$ and varies depending on a treating method for smoothing after coating and required gloss. The gloss-providing layer is formed on the ink-receiving layer, and may be formed on at least two ink-receiving layer.

In the gloss-providing layer, the synthetic polymer latex may be used in combination of at least one of the other binders mentioned as the binder to be used for the ink-receiving layer.

It is preferred that the gloss-providing layer in the present invention contains an ampholite as an essential component.

When the gloss-providing layer contains an ampholite, the water retention of the gloss-providing layer is improved, and high gloss can be attained. The moisture condition of the gloss-providing layer at the time of cast treatment affects gloss. Therefore, when the gloss-providing layer contains much moisture in its surface portion, smoothing of the gloss-providing layer can be promoted, whereby a highly glossy surface can be obtained.

The ampholite to be used in the present invention is an organic or an inorganic substance which is cationic under an acidic atmosphere and is anionic under an alkaline atmosphere. It includes oligopeptides, polypeptides, proteins, aluminum hydroxide, zinc oxide and the like. Because the ampholite adsorbs on the colloidal particles and aggregates the colloidal particles to improve the water retention of the gloss-providing layer, the gloss can be improved on cast treatment. However, if a cationic electrolyte is added to anionic colloidal particles, or if an anionic electrolyte is added to cationic colloidal particles, the colloidal particles will be aggregated (or bonded) firmly to form substantially enlarged particles, whereby the gloss-providing layer will be opaque, and printed image density will be low.

The amount of the ampholite is preferably from 0.05 to 20 parts by weight, more preferably from 0.1 to 15 parts by weight per 100 parts by weight of the colloidal particles, although it depends on types of ampholite, the colloidal particles and the binder constituting the gloss-providing layer, and the solid content.

It is also preferred that the gloss-providing layer in the present invention further contains smectite as an essential component, in view of the feeding property.

As described above, the gloss is influenced by the moisture condition of the gloss-providing layer at the time of cast treatment. From this viewpoint, since smectite enhances the water retention of the gloss-providing layer, it can improve the gloss. In addition, use of smectite can improve the feeding property in an ink jet printer apparatus without lowering the ink penetrability which is an essential function of the gloss-providing layer in the present invention.

Smectite is a type of clay mineral which has a layered structure, a cation ion exchanging property and swelling property. As specific examples of smectite, montmorillonite, hectorite, beidelite, saponite, nontronite, chlorite, fluorine-type mica and a synthetic material which is a substituted form thereof, and a compound which is smectite having alumina, silica, titania, zirconium, iron or a metal complex inserted between its layers, may be mentioned.

Smectite captures water molecules in a coating composition for the gloss-providing layer between its layers and swells enlarging spaces between layers. Since incorporation of smectite prevents water from penetrating into the ink-receiving layer so that much water is retained in the gloss-providing layer at the time of cast treatment, it is possible to improve the gloss. Although the specular-finished gloss-providing layer is not only smooth but also highly adhesive, it is possible to obtain a surface which is highly adhesive but has a good sliding property by virtue of smectite, which reduces friction. Further, since smectite does not form a film, it never lowers the ink penetrability.

The amount of smectite is at least 0.5 parts by weight, preferably from 0.5 to 10 parts by weight, particularly preferably from 1 to 4 parts by weight per 100 parts by weight of the colloidal particles. If the amount is less than 0.5 part by weight, the water retention is hardly improved, although it depends on the solid content of the coating composition for the gloss-providing layer. If the amount is more than 10 parts by weight, since the improvement in the sliding property attributable to smectite results in excessive reduction of the frictional force in an ink jet recording apparatus, some types of ink jet recording apparatus may have a problem in the feeding property.

To the gloss-providing layer, a dye-fixing agent, a pigment dispersant, a thickener, a fluidity-improving agent, a defoaming agent, a foam-suppressing agent, a release agent, a blowing agent, a penetrating agent, a coloring dye, a coloring pigment, a fluorescent brightener, an ultraviolet absorber, an antioxidant, a preservative, an ash-preventive agent, a waterproofing agent, a wet strength agent or dry strength agent may suitable be incorporated as additives.

Although the amount of the gloss-providing layer to be coated depends on smoothness of the ink-providing layer, conditions for drying the gloss-providing layer and the particle size of the colloidal particles, the gloss intended in the present invention can be attained with the amount of the gloss-providing layer of at least 2 $g/m^2$.

It is possible to form a predetermined amount of the gloss-providing layer in two coating steps. In such a case, the gloss is improved as compared with the same amount of the gloss-providing layer is formed in one coating step. It is particularly preferred that plural gloss-providing layers are formed so that the electric charge on the surfaces of the colloidal particles constituting those gloss-providing layers are different, since the gloss is further improved.

As an apparatus for coating the ink-receiving or gloss-providing layer, various apparatus such as a blade coater, a roll coater, an air knife coater, a bar coater, a rod blade coater, a curtain coater, a short dwell coater or a size press, can be used on machine or off machine. Further, after coating the ink-receiving or the gloss-providing layer, finishing may be applied by means of a calender such as a TG calender, a super calender or a soft calender.

Further, a back coat layer may be formed on the side of the support opposite to the ink-receiving layer so as to sandwich the support with the ink-receiving layer, in order to provide a curling suitability. In such a case, as a pigment, a plainer pigment or hydrolized halloysite is preferred. Still further, humid air or steam may be blown to the back of the support after cast treatment to cure curling.

Although the ink jet recording sheet of the present invention has an excellent gloss even when it is prepared only by coating the gloss-providing layer on the ink-receiving layer and then drying it, it is possible to further improve the gloss by further applying a calender treatment to it. Since there is no need to conduct the calender treatment under a high linear load at a high temperature, voids in the coated layer layer do not decrease enough to lower the ink absorptivity, whereby it is possible to obtain an ink jet recording sheet which satisfies the object of the present invention.

It is also possible to further improve the gloss of the ink jet recording sheet of the present invention, by press contacting the gloss-providing layer in a wet state to a specular roll for specular finish (hereinafter referred to as cast treatment).

There are three methods for cast treatment, the direct method, a coagulation method and the re-wet method. In these methods, after the ink-receiving layer is coated and dried, the coating composition for the gloss-providing layer is coated, and the coated surface in a wet state is press-contacted to a heated specular roll, dried and then released from the roll to form a replica of the surface of the specular roll on the coated surface. In the direct method, after the gloss-providing layer is formed by coating, it is press-contacted to a heated specular roll while it is still in a wet state and then dried. In the coagulation method, the coating composition for the gloss-providing layer is coagulated with an acidic solution or an alkaline solution and then press-contacted to a heated specular roll, and the coagulation method includes the heat coagulation method. In the re-wet method, after the gloss-providing layer is coated and dried, the gloss-providing layer is re-wetted with a liquid composed mainly of water and then press-contacted to a heated specular roll and dried.

Any of these method for cast treatment can be applied to the ink jet recording sheet of the present invention. Particularly, the direct method is preferred in order to obtain an ink jet recording sheet having a high glossiness. The surface roughness, the surface temperature, the diameter of the specular roll, the pressure at the time of press-contacting (linear load) and the coating speed can be suitably selected, similarly to conditions for production of commercially available cast coated paper.

By the process for producing an ink jet recording sheet of the present invention, an ink jet recording sheet which has an excellent gloss and is excellent in ink absorptivity and capable of presenting a high printed image density, can be obtained. In the process for producing an ink jet recording sheet of the present invention, the ink-receiving layer and the gloss-providing layer are laminated on a support successively, and the gloss-providing layer is subjected to cast treatment.

The gloss-providing layer in the present invention is formed from a coating composition composed mainly of colloidal particles. By subjecting the gloss-providing layer to the cast treatment, a specular gloss can be obtained. The moisture condition of the gloss-providing layer affects the gloss. Since the ink-receiving layer adjacent to the gloss-providing layer has ink absorptivity, it absorbs water in the coating composition for the gloss-providing layer. Therefore, when the cast treatment is conducted by the direct method in which the cast treatment is conducted immediately after the gloss-providing layer has been coated, it is possible to obtain an ink jet recording sheet having a still higher gloss, since little water migrates from the gloss-providing layer to the ink-receiving layer and the gloss-providing layer is still kept in a wet state. The time between the coating of the gloss-providing layer and the cast treatment is at most 20 seconds, preferably at most 10 seconds.

By controlling the temperature of the specular roll, the linear load at the time of the press-contacting and the cast treating speed, it is possible to obtain an ink jet recording sheet having a glossy surface with a 75° C. specular gloss of at least 70% as stipulated in JIS-Z8741, which is comparable to that of commercially available cast coated paper.

It is possible to employ a specific method so called modified re-wet method for cast treatment of the ink jet recording sheet of the present invention. In the modified re-wet method, after the ink-receiving layer has been coated and dried, the coating composition for the gloss-providing layer is coated, the surface of the gloss-providing layer is temporarily solidified by using an infrared dryer, then re-wetted, press-contacted to a heated specular roll, dried and released from the roll, to form a replica of the surface of the specular roll on the gloss-providing layer. In this method, since only the surface of the gloss-providing layer is solidified, the water content in the gloss-providing layer is small as compared with the case of the coagulation method, whereby production at a high speed is possible. In addition, unlike the re-wet method wherein the gloss-providing layer is completely dried, since the inside of the gloss-providing layer is maintained in a wet state, a high gloss can be obtained.

Further, by press contacting the gloss-providing layer to a heated specular roll within 5 seconds of the re-wetting of the gloss-providing layer, it is possible to dry the gloss-providing layer before the supplied water is absorbed in the ink-receiving layer, and as a result, it is possible to obtain a high glossiness. The time between the re-wetting and the press contacting to a heated specular is determined by the coating speed and the distance between the apparatus supplying water and the specular roll and can be adjusted in terms of the coating speed and the distance.

There are some methods for temporarily drying the gloss-providing layer such as steam heating, gas heating, hot-air heating and the like. However, in these drying methods, since the whole gloss-providing layer is dried and solidified, a specular gloss can hardly be obtained even after its re-wetting. Besides, since the gloss-providing layer is dried unevenly in the direction of its thickness, uneven drying and migration of the binder occur, and the gloss-providing layer is press-contacted to the specular roll unevenly. As a result, uneven gloss is provided.

However, by use of an infrared dryer, it is possible to dry the gloss-providing layer evenly in the direction of its thickness and to re-wet the gloss-providing layer without drying or solidifying the whole gloss-providing layer. Thus, since it is possible to solidify only the surface of the gloss-providing layer while smoothing it, even if water is supplied to the gloss-providing layer for re-wetting, the gloss-providing layer never runs out. The infrared dryer to be used in the present invention employs tungsten or gas as a filament to generate an infrared ray.

As the method for re-wetting in the process of the present invention, a method wherein a re-wetting fluid is supplied at the time of press contacting to the specular roll, a method steam is used for moistening, and a method wherein a re-wetting fluid is coated by means of a roll coater or the like, may be mentioned. As the re-wetting fluid, it is common to use water. However, a release agent such as a polyethylene emulsion, a fatty acid soap or a surfactant may be incorporated in the re-wetting fluid.

The water-color ink in the present invention is a recording liquid comprising a coloring agent, a liquid medium and other additives.

As the coloring agent, a water-soluble dye such as a direct dye, an acid dye, a basic dye, a reactive dye or a dye for food, may be mentioned.

The medium for the water-color ink includes water and various water-soluble organic solvents, for example, a $C_{1-4}$ alkyl alcohol such as methyl alcohol, ethyl alcohol, n-propyl alcohol, isopropyl alcohol, n-butyl alcohol, sec-butyl alcohol, tert-butyl alcohol or isobutyl alcohol; an amide such as dimethylformamide or dimethylacetamide; a ketone or ketone alcohol such as acetone or diacetone alcohol; an ether such as tetrahydrofuran or dioxane; a polyalkylene glycol such as polyethylene glycol or polypropylene glycol; an alkylene glycol having from 2 to 6 alkylene groups such as ethylene glycol, propylene glycol, butylene glycol, triethylene glycol, 1,2,6-hexanetriol, thiodiglycol, hexylene glycol or diethylene glycol; a lower alkyl ether of polyhydric alcohol such as glycerol, ethylene glycol methyl ether, diethylene glycol methyl (or ethyl) ether or triethylene glycol monomethyl ether.

Among such many water-soluble organic solvents, a polyhydric alcohol such as diethylene glycol, or a lower alkyl ether of a polyhydric alcohol such as triethylene glycol monomethyl ether or triethylene glycol monomethyl ether, is preferred.

As other additives, a pH controlling agent, a sequestering agent, a mildewproofing agent, a viscosity controlling agent, a surface tension controlling agent, a wetting agent, a surfactant and a rust preventing agent may, for example, be mentioned.

The ink jet recording sheet of the present invention may be used as any recording sheet of the type to be used for recording with a liquid ink. For example, it may be an image-receiving sheet for heat transfer recording of the type, whereby an ink sheet having a heat meltable ink containing e.g. a heat meltable substance, a dye or pigment, etc. as the main components, coated on a thin support such as a resin film, a high density paper or a synthetic paper, is heated from its rear side to melt and transfer the ink to the image-receiving sheet, an ink jet recording sheet of the type to which a heat meltable ink which has been melted on heating is jetted in the form of fine droplets for recording, or an image-receiving sheet corresponding to a photo- and pressure-sensitive donor sheet employing microcapsules containing a photo polymerizable monomer and a colorless or colored dye or pigment.

A common feature of these recording sheets is that the ink is in a liquid state at the time of recording. A liquid ink will penetrate or diffuse in the depth direction or horizontal direction of the ink-receiving layer of the recording sheet before hardening, immobilizing or fixing. The above-mentioned various recording sheets require absorptivity suitable for the respective systems, and the ink jet recording sheet of the present invention may be used as any of the above-mentioned various recording sheets.

Further, the ink jet recording sheet of the present invention may be used as a recording sheet for the electrographic recording system which is employed in many copying machine and printers, to which sheet a toner is fixed on heating. The ink jet recording sheet of the present invention may have an adhesive layer on it for its application to a label.

The ink jet recording sheet of the present invention not only may be fed to a recording apparatus in the form of cut sheets, but also may be fed continuously in the form of a web.

It depends on the particle size of the pigment constituting a coating layer, whether gloss is provided or not, and when the particle size is from 200 to 300 nm, the glossiness tends to be maximal. Since porous pigments generally used for an ink jet recording sheet of the coat type take the form of secondary or tertiary agglomerated particles, most of them have particle sizes of at least 103nm. Therefore, with such porous pigments, the gloss intended in the present invention, which is comparable to that of commercially available art coated paper can not be provided. However, since a porous pigment itself has a voided structure, it is an essential material in order to secure ink absorptivity. Thus, with the presently available techniques, it is difficult to provide both of these mutually opposing properties, gloss and ink absorptivity.

Glossiness is obviously associated with reflection of light from a surface, and its degree depends on the roughness of the surface. On this base, the present inventors intended to secure ink absorptivity inside an ink jet recording sheet while smoothing the surface, and found that the objects of the present invention can be attained by an ink jet recording sheet of a double layered structure having a gloss-providing layer comprising a specific colloidal particles and an ink-receiving layer. Especially, when the support is made mainly from wood pulp, it is possible to secure ink absorptivity since the solvent component in an ink is absorbed by the support.

An ink jet recording sheet which is excellent in ink absorptivity, capable of preventing a high printed image density and has a glossiness comparable to that of commercially available cast coated paper, can be obtained by employing a double-layered structure which is composed of a gloss-providing layer and an ink-receiving layer, as demonstrated in examples which will be described later. In the ink jet recording sheet of the present invention, the gloss-providing layer is excellent in transparency and has a function to swiftly migrate most of the printed ink to the ink receiving layer. By subjecting the gloss-providing layer to cast treatment, it is possible to further improve the gloss.

The gloss-providing layer is formed from a coating composition comprising colloidal particles and a synthetic polymer latex as the main components, and the ink-receiving layer is formed from a coating composition comprising a pigment and a binder as the main components. When the colloidal particles have negative or no charge on their surfaces, an ink migrates to the adjacent ink-receiving layer, since such particles do not have a function to capture and fix the ink. For this reason, the gloss-providing layer is required to have transparency, and by use of colloidal particles having an average particle size of at most 300 nm, it is possible to secure the transparency, and thereby it is possible to obtain an image of a high printed image density without conceal the ink absorbed and fixed in the ink-receiving layer. When, the colloidal particles have a porous structure, the ink is retained in the gloss-providing layer, therefore an image of a high printed image density can be obtained. However, use of colloidal particles having a large average particle size, even if they have a porous structure, results in decrease in the amount of the ink obtained in the gloss-providing layer and enhanced opaqueness due to their small surface areas.

Further, when the colloidal particles have positive charge on their surfaces, the dye component in an ink is captured and fixed in the gloss-providing layer, and the solvent component is absorbed by the adjacent ink-receiving layer. Therefore, an ink jet recording sheet capable of presenting a high printed image density and excellent in ink absorptivity can be obtained.

Although use of organic particles with a high thermoplasticity as the colloidal particles affords an ink jet recording sheet having high gloss, it also results in deterioration of the releasability of the gloss-providing layer from a specular roll due to the adhesiveness to the specular roll enhanced by the organic particles and deterioration of the ink penetrability due to fusion of the organic particles. As a result, the gloss-providing layer is likely to be peeled off and to get damage on its surface, and the image quality tends to deteriorate accompanying deterioration of the ink absorptivity. However, the combined use of colloidal silica and organic particles makes it possible not only to improve releasability to avoid a damaged surface but also to avoid deterioration of ink penetrability to secure ink absorptivity, while maintaining the improved gloss attributable to the use of organic particles.

By virtue of the use of a synthetic polymer latex as a binder in the gloss-providing layer, the ink jet recording sheet of the present invention has an improved folding strength. In-order to avoid deterioration of the gloss of the gloss-providing layer, a synthetic polymer latex having a particle size of at most 100 nm is particularly preferred as the synthetic polymer latex. By the use of such a polymer latex, development of opaqueness can be prevented, and thereby lowering in the printed image density can be prevented, while the folding strength is secured.

By incorporation of an ampholite into the gloss-providing layer, the water retention of the gloss-providing layer is improved, presumably due to adsorption of the ampholite by the colloidal particles. As a result of the adsorption, water is interposed between the colloidal particles, whereby the water retention is improved. Accordingly, in the case of cast treatment by the direct method, the gloss is improved since the gloss-providing layer becomes wetter. In the case of the rewet method or the coagulation method, since the amount of the water captured in the gloss-providing layer increases, the gloss improves.

By incorporation of smectite into the gloss-providing layer, the water retention of the gloss-providing layer is improved. Since smectite has ink penetrability, it does not lower the ink absorptivity unlike a polymeric humectant. Further, since smectite has a sliding property, it improves the feeding property in an ink jet recording apparatus.

The ink-receiving layer has a function to fix an ink. The use of a pigment containing particles having particle sizes of at most 1.0 μm in an amount of at least 30 vol %, particularly cationic colloidal particles, prevents ink from blotting under highly humid circumstances, since such particles do not dissolve or disintegrate upon addition of water. The ink-receiving layer has another function to decide the degree of the gloss of the gloss-providing layer. For example, in an ink jet recording sheet prepared by successively forming an ink-receiving layer and the gloss-providing layer on a support mainly made from wood pulp, since the ink-receiving layer fills the voids on the surface of the support, the smoothness of the gloss-providing layer is improved, whereby the gloss can be greatly improved. Particularly, by forming the ink-receiving layer and the gloss-providing layer from coating compositions containing cationic colloidal particles as main components, an image of a high printed image density can be obtained since it is possible to fix ink in both layers.

Now, the present invention will be described in further detail with reference to Examples. However, it should be understood that the present invention is by no means restricted to such specific Examples. In the Examples, "parts" and "%" mean "parts by absolute dry weight" and "% by absolute dry weight" unless otherwise specified. The particle sizes shown in Examples are the average particle sizes measured by the dynamic light scattering method.

In the following Examples and Comparative Examples, the same supports, which were prepared as follows, were used.

Preparation of supports

To 100 parts of wood pulp comprising 80 parts of LBKP (freeness 400 mlcsf) and 20 parts of NBKP (freeness 450 mlcsf), 25 parts of a pigment composed of light calcium carbonate/heavy calcium carbonate/talc in a ratio of 10/10/10, 0.10 part of commercially available alkylketene dimer, 0.03 part of commercially available cationic (meth)acrylamide, 0.80 part of commercially available cationic starch and 0.40 part of aluminum sulfate were added. Then, the resulting pulp slurry was formed into paper of 90 g/m$^2$ by means of a Fourdrinier paper machine to obtain supports.

The ink jet recording sheets prepared in these Examples and Comparative Examples were evaluated in accordance with the following evaluation methods. The measurement and the evaluation were conducted under the environmental conditions stipulated in JIS-P8111.

Specular gloss

The specular gloss of the surface of a gloss-providing layer was measured in accordance with the method stipulated in JIS-Z8741, with angles of incidence and reflection of 75° by means of a variable-angle glossmeter (VGS-1001DP, manufactured by Nippon Denshoku Kogyo). For reference, the specular gloss of commercially available cast coated paper is at least 70%.

Ink absorptivity

Using an ink jet recording apparatus (BJC-820J: manufactured by CANON INC.), a rectangular pattern was overprinted with cyan ink and magenta ink, and the pattern was evaluated with the naked eye in accordance with the following evaluation standards.

A: No deformation of the rectangular pattern was observed.

B: The rectangular pattern was slightly deformed, but no diffusion of the ink along the surface was observed.

C: The rectangular pattern was deformed, and diffusion of the ink along the surface was observed.

For a good ink absorptivity, evaluation as A or B is necessary.

Printed image density

Using the above-mentioned ink jet recording apparatus, a solid pattern was printed with black ink and the optical reflection density at the printed portion was measured by means of Macbeth RD-918 model. The color effect is appreciably poor, when the optical reflection density is less than 1.25.

Folding strength

Each ink jet recording sheet obtained in Examples and Comparative Examples was folded in two, and evaluated in terms of peeling of the coating layer on the fold with the naked eye in accordance with the following standards.

A: The coating layer did not peel off at all.

B: The coating layer did not peel off, but cracks were observed on the fold.

C: Peeling of the coating layer was observed.

For a sufficient folding strength, evaluation as A or B is essential.

Releasability from a specular roll

The releasability from a specular roll was evaluated in terms of pits on the surface of an ink jet recording sheet having been passed along the specular roll. Pits are formed when parts of the gloss-providing layer are taken away by a specular roll due to poor releasability. A portion where pits are formed is not only dull, but also can provide only an image with a poor image quality. The releasability was evaluated in accordance with the following standards with the naked eye. The sufficient level in practical use is ○. ○: There is no pit on the surface of a sheet. Δ: There are a few pits on the surface of a sheet.

x: There are pits all over the surface of a sheet.

EXAMPLE 1

Coating of an ink-receiving layer

On the surface of a support, an ink-receiving layer was formed.

The coating composition for the ink-receiving layer was prepared by using 100 parts of synthetic amorphous silica (Fine seal X37B: manufactured by Tokuyama Soda Co., Ltd.), 30 parts of polyvinyl alcohol (PVA117: Kuraray Co., Ltd.), 30 parts of colloidal silica (Snowtex-0: manufactured by NISSAN CHEMICAL INDUSTRIES, LTD.) and 20 parts of a cationic dye-fixing agent (Sumirez resin 1001: manufactured by SUMITOMO CHEMICAL CO., LTD.) so that the solid content would be 15%. The coating composition was coated on the support by means of an air knife coater so that the dry coated amount would be 8 g/m$^2$ and then dried.

Coating of a gloss-providing layer

On the surface of the ink-receiving layer, a gloss-providing layer was formed. The coating composition for the gloss-providing layer was prepared by using 100 parts of colloidal silica having a particle size of 300 nm (PST-3: manufactured by NISSAN CHEMICAL INDUSTRIES, LTD.) as colloidal particles and 5 parts of a commercially available styrene-butadiene latex (0693: manufactured by Japan Synthetic Rubber Co., Ltd.) as a binder so that the solid content would be 20%. The coating composition was coated so that the dry coated amount would be 5 g/m$^2$, dried and then subjected to calender treatment so that the coated surface of the gloss-providing layer would be brought into contact with a chilled roll, under conditions in which the temperature of the surface of the chilled roll was 50° C., and the linear pressure was 100 kg/cm, to obtain an ink jet recording sheet, Example 1.

EXAMPLE 2

An ink-receiving layer was formed on a support in the same manner as in Example 1. Then a gloss-providing layer was formed on the surface of the ink-receiving layer. The coating composition for the gloss-providing layer was prepared by using 100 parts of a polystyrene-type organic pigment having an average particle size of 200 nm (L8999: manufactured by Asahi Chemical Industry Co., Ltd.) as colloidal particles and 5 parts of the same latex as in Example 1 as a binder. After the solid content of the composition had been adjusted to 40%, the composition was coated by means of an air knife coater so that the dry coated amount would be 3 g/m$^2$, dried and subjected to calender treatment under the same conditions as in Example 1, to obtain an ink jet recording sheet, Example 2.

EXAMPLE 3

An ink-receiving layer was formed on a support in the same manner as in Example 1. Then, a gloss-providing layer was formed on the surface of the ink-receiving layer.

The coating composition for the gloss-providing layer was prepared by using 100 parts of colloidal silica having an average particle size of 65 nm (Snowtex YL: manufactured by NISSAN CHEMICAL INDUSTRIES, LTD.) as colloidal particles and 5 parts of the same latex as in Example 1 as a binder. After the solid content of the composition had been adjusted to 25%, the composition was coated by means of an air knife coater so that the dry coated amount would be 10 g/m$^2$, dried and then subjected to calender treatment under the same conditions as in Example 1, to obtain an ink jet recording sheet, Example 3.

EXAMPLE 4

An ink-receiving layer was formed on a support in the same manner as in Example 1, and then a gloss-providing layer was formed on the surface of the ink-receiving layer.

The coating composition for the gloss-providing layer was prepared by using 100 parts of porous amorphous silica.alumina having an average particle size of 40 nm and a silica/alumina weight ratio of 75/25 (USB-1: manufactured by CATALYST & CHEMICALS IND. CO., LTD.) as colloidal particles and 5 parts of the same latex as in Example 1 as a binder. After the solid content of the composition had been adjusted to 20%, the composition was coated by means of an air knife coater so that the dry coated amount would be 10 g/m$^2$, dried and subjected to calender treatment under the same conditions as in Example 1, to obtain an ink jet recording sheet, Example 4.

EXAMPLE 5

An ink-receiving layer was formed in the same manner as in Example 1, and then a gloss-providing layer was formed on the surface of the ink-receiving layer.

The coating composition for the gloss-providing layer was prepared by using 100 parts of cationic colloidal silica having an average particle size of 80 nm (Snowtex AK-ZL:: manufactured by NISSAN CHEMICAL INDUSTRIES, LTD.) as colloidal particles and 5 parts of a commercially available cationic latex as a binder. After the solid content of the composition had been adjusted to 25%, the composition was coated by means of an air knife coater so that the dry coated amount would be 5 g/m$^2$, dried and then subjected to calender treatment under the same conditions as in Example 1, to obtain an ink jet recording sheet, Example 5.

Comparative Example 1

An ink-receiving layer was formed on a support in the same manner as in Example 1. Then, a gloss-providing layer was formed on the ink-receiving layer.

The coating composition for the gloss-providing layer was prepared by using 100 parts of silica (Nipsil E220A: manufactured by NIPPON SILICA INDUSTRIAL CO., LTD.) which is a porous pigment having an average particle size of 1000 nm as a pigment and 5 parts of the same latex as in Example 1 as a binder. After the solid content of the composition had been adjusted to 25%, the composition was coated by means of an air knife coater so that the dry coated amount would be 5 g/m$^2$, dried and then subjected to calender treatment under the same conditions as in Example 1, to obtain an ink jet recording sheet, Comparative Example 1.

TABLE 1

| Example or Comparative Example | 75° Specular gloss (%) | Ink absorptivity | Printed image density |
|---|---|---|---|
| Example 1 | 52 | B | 1.26 |
| Example 2 | 68 | B | 1.29 |
| Example 3 | 40 | B | 1.45 |
| Example 4 | 47 | A | 1.65 |
| Example 5 | 33 | A | 1.54 |
| Comparative Example 1 | 7 | C | 1.22 |

From Table 1, it is clear that Examples 1 to 5, each having a gloss-providing layer mainly composed of colloidal particles having an average particle size of at most 300 nm on the surface of its ink-receiving layer, have gloss comparable to that of commercially available art coated paper, while having high printed image densities and excellent ink absorptivities. On the other hand, with respect to Comparative Example 1 in which silica which is a porous pigment having an average particle size of 1000 nm, was used, high gloss was not obtained, and the printed image density was low.

EXAMPLE 6

Coating of an ink-receiving layer

An ink-receiving layer was formed on the surface of a support. The coating composition for the ink-receiving layer was prepared by using 100 parts of alumina hydrate (Cataloid AS-3: manufactured by CATALYST & CHEMICALS IND. CO., LTD.; average particle size 10 nm) as cationic colloidal particles and 30 parts of polyvinyl alcohol (PVA117: manufactured by Kuraray Co., Ltd.) as a binder. After the solid content of the composition had been adjusted to 10%, the composition was coated by means of an air knife coater so that the dry coated amount would be 5 g/m$^2$ and then dried.

Coating of a gloss-providing layer

A gloss-providing layer was formed on the surface of the ink-receiving layer. The coating composition for the gloss-providing layer was prepared by using 100 parts of a polystyrene-type organic pigment having an average particle size of 200 nm (L8999: manufactured by Asahi Chemical Industry Co., Ltd.) as colloidal particles and 5 parts of a commercially available carboxy-modified styrene.butadiene-type latex as a binder. After the solid content of the composition had been adjusted to 45%, the composition was coated by means of an air knife coater so that the dry coated amount would be 3 g/m$^2$, dried and then subjected to calender treatment under the same conditions as in Example 1, to obtain an ink jet recording sheet, Example 6.

EXAMPLE 7

Coating of an ink-receiving layer

An ink-receiving layer was formed on the surface of a support. The coating composition for the ink-receiving layer was the same as in Example 6, and it was coated by means of a gate roll coater so that the dry coated amount would be 2 g/m$^2$ and then dried.

Coating of a gloss-providing layer

A gloss-providing layer was formed on the surface of the ink-receiving layer. The coating composition for the gloss-providing layer was prepared by using 100 parts of colloidal silica having an average particle size of 65 nm (Snowtex YL: manufactured by NISSAN CHEMICAL INDUSTRIES, LTD.) as colloidal particles and 5 parts of the same latex as in Example 1 as a binder. After the solid content of the coating composition had been adjusted to 40%, the coating composition was coated by means of an air knife coater so that the dry coated amount would be 10 g/m$^2$, dried and then subjected to calender treatment under the same conditions as in Example 1, to obtain an ink jet recording sheet, Example 7.

EXAMPLE 8

Coating of an ink-receiving layer

An ink-receiving layer was formed on the surface of a support. The coating composition for the ink-receiving layer was prepared by using 100 parts of needle-like cationic colloidal silica (Snowtex UP-AK(1): manufactured by NISSAN CHEMICAL INDUSTRIES, LTD.; average particle size agglomerates of 10 to 20 nm wide and 50 to 200 nm long) which is needle-like colloidal silica modified with aluminum oxide hydrate, as cationic colloidal particles, and 30 parts of polyvinyl alcohol (PVA117: manufactured by Kuraray Co., Ltd.) as a binder. After the solid content of the composition had been adjusted to 10%, the composition was coated by means of a gate roll coater so that the dry coated amount would be 2 g/m$^2$ and then dried.

Coating of a gloss-providing layer

A gloss-providing layer was formed on the surface of the ink-receiving layer. The coating composition for the gloss-providing layer was prepared by using 100 parts of porous amorphous silica.alumina having an average particle size of 40 nm (USB-1: manufactured by CATALYST & CHEMICALS IND. CO., LTD.) as colloidal particles and 5 parts of the same latex as in Example 1 as a binder. After the solid content of the composition had been adjusted to 20%, the composition was coated by means of an air knife coater so that the dry coated amount would be 10 g/m$^2$, dried and then subjected to calender treatment under the same conditions as in Example 1, to obtain an ink jet recording sheet, Example 8.

EXAMPLE 9

Coating of an ink-receiving layer

An ink-receiving layer was formed on the surface of a support. The coating composition for the ink-receiving layer was the same as in Example 8, and it was coated by means of a gate roll coater so that the dry coated amount would be 1 g/m$^2$ and then dried.

Coating of a gloss-providing layer

A gloss-providing layer was formed on the surface of the ink-receiving layer. The coating composition for the gloss-providing layer was prepared by 100 parts of cationic colloidal silica having an average particle size of 80 nm (Snowtex AK-ZL: manufactured by NISSAN CHEMICAL INDUSTRIES, LTD.) as colloidal particles and 5 parts of a commercially available nonionic acrylic emulsion as a binder. After the solid content of the composition had been adjusted to 30%, the composition was coated by means of an air knife coater so that the dry coated amount would be 10 g/m$^2$, dried and subjected to calender treatment under the same conditions as in Example 1, to obtain an ink jet recording sheet, Example 9.

Comparative Example 2

The coating composition for the gloss-providing layer in Example 7 was coated on the surface of a support without formation of an ink-receiving layer. Coating, drying and calender treatment were conducted under the same conditions as used in Example 7 at the time of formation of the gloss-providing layer, to obtain an ink jet recording sheet, Comparative Example 2.

Comparative Example 3

An ink-receiving layer was formed in the same manner as in Example 6.

Coating of a qloss-providing layer

A gloss-providing layer was formed on the surface of the ink-receiving layer. The coating composition for the gloss-providing layer was prepared by using 100 parts of silica which is a porous pigment having an average particle size of 1000 nm (Nipsil E220A: manufactured by NIPPON SILICA INDUSTRIAL CO., LTD.) as a pigment and 5 parts of the same latex as in Example 1 as a binder. After the solid content of the composition had been adjusted to 20%, the composition was coated by means of an air knife coater so that the dry coated amount would be 10 g/m$^2$, dried and the subjected to calender treatment under the same conditions as in Example 1, to obtain an ink jet recording sheet, Comparative Example 3.

TABLE 2

| Example or Comparative Example | 75° Specular gloss (%) | Ink absorptivity | Printed image density |
|---|---|---|---|
| Example 6 | 68 | A | 1.30 |
| Example 7 | 48 | A | 1.47 |
| Example 8 | 50 | A | 1.61 |
| Example 9 | 41 | A | 1.67 |
| Comparative Example 2 | 38 | C | 1.12 |
| Comparative Example 3 | 8 | B | 1.10 |

As is evident from Table 2, Examples 6 to 9, each of which has an ink-receiving layer containing cationic colloidal particles and a gloss-providing layer containing colloidal particles on the surface of a support, have gloss comparable to that of commercially available art coated paper, while presenting high printed image densities and being excellent in ink absorptivity. Particularly, Example 9, which contains cationic colloidal particles both in the ink-receiving layer and in the gloss-providing layer can present a high printed image density.

However, with respect to Comparative Example 2, which has no ink-receiving layer on the support and prepared by using non-cationic colloidal particles, the printed image density was low, and the ink absorptivity was insufficient.

With respect to Comparative Example 3, in which an ink-receiving layer was formed on the support and a coating composition composed mainly of a porous pigment was coated on the surface of the ink-receiving layer, it is shown that the gloss and the printed image density were low. The reasons for the low gloss and printed image density are presumed as follows. The low gloss is attributable to the large particle size of the porous pigment, and the low printed image density is attributable to development of opaqueness.

EXAMPLE 10

An ink-receiving layer was formed in the same manner as in Example 1.

Coating of a gloss-providing layer

A gloss-providing layer was formed on the surface of the ink-receiving layer. The coating composition for the gloss-providing layer was prepared by using 20 parts of colloidal particles having an average particle size of 40 nm which comprises silica particles and alumina particles in a silica particle/alumina particle ratio of 75/25 (USB-1: manufactured by CATALYST & CHEMICALS IND. CO., LTD.) and 80 parts of colloidal particles having a particle size of 65 nm (Snowtex YL: manufactured by NISSAN CHEMICAL INDUSTRIES, LTD.) as a pigment and 5 parts of the same latex as in Example 1 as a binder, so that the solid content would be 35%. The coating composition was coated on the surface of the ink-receiving layer by means of an air knife coater so that the dry coated amount would be 10 g/m$^2$, and then dried. Then, the surface of the gloss-providing layer was subjected to supercalender treatment under the same conditions as in Example 1, to obtain an ink jet recording sheet, Example 10.

EXAMPLE 11

An ink-receiving layer was formed in the same manner as in Example 1.

Coating of a gloss-providing layer

A gloss-providing layer was formed on the surface of the ink-receiving layer. The coating composition for the gloss-providing layer was prepared in the same manner as in Example 4 except that the colloidal particles used in Example 4 were replaced with colloidal particles having an average particle size of 125 nm. By employing the same conditions for coating, drying and calender treatment as in Example 1, an ink jet recording sheet, Example 11, was obtained.

EXAMPLE 12

An ink-receiving layer was formed in the same manner as in Example 1.

Coating of a gloss-providing layer

A gloss-providing layer was formed on the surface of the ink-receiving layer. The coating composition for the gloss-providing layer was prepared in the same manner as in Example 4 except that the colloidal particles used in Example 4 were replaced with colloidal particles having a particle size of 198 nm. The same conditions for coating, drying and calender treatment as in Example 1 were employed to obtain an ink jet recording sheet, Example 12.

EXAMPLE 13

An ink-receiving layer was formed in the same manner as in Example 1.

Coating of a gloss-providing layer

A gloss-providing layer was formed on the surface of the ink-receiving layer. The coating composition for the gloss-providing layer was prepared in the same manner as in Example 2 except that the colloidal particles used in Example 2 were replaced with colloidal particles having a particle size of 100 nm. The same conditions for coating, drying and calender treatment as in Example 1 were employed to obtain an ink jet recording sheet, Example 13.

TABLE 3

| Example or Comparative Example | 75° Specular gloss (%) | Ink absorptivity | Printed image density |
|---|---|---|---|
| Example 4 | 47 | A | 1.65 |
| Example 10 | 51 | A | 1.61 |
| Example 11 | 55 | A | 1.59 |
| Example 12 | 60 | A | 1.52 |
| Example 3 | 40 | B | 1.45 |
| Example 13 | 57 | B | 1.30 |

From Table 3, it is clear that by using amorphous silica.alumina having a porous structure as colloidal particles in the gloss-providing layer in the present invention, it is possible to obtain an ink jet recording sheet which has a high gloss and is capable of presenting an image with a high printed image density even if the particle size of the colloidal particles is increased.

EXAMPLE 14

Coating of an ink-receiving layer

An ink-receiving layer was formed on the surface of a support. The coating composition for the ink-receiving layer was prepared by adding 7 parts of a commercially available styrene-butadiene-type latex to a pigment slurry with a solid content of 70% comprising 100 parts of kaolin having 30.2 vol % of particles having a particle size of at most 1.0 μm (Ultrawhite 90: manufactured by ENGELHARD CORPORATION) and 0.1 part of a commercially available polyacrylic acid-type dispersant and then adjusting the pH to 9.5 and the solid content to 60%. The coating composition was coated by means of a blade coater so that the dry coated amount would be 15 g/m$^2$ and then dried.

Coating of a gloss-providing layer

A gloss-providing layer was formed on the surface of the ink-receiving layer. The coating composition for the gloss-providing layer was prepared by using 100 parts of an alumina sol (Cataloid AS3: manufactured by CATALYST & CHEMICALS IND. CO., LTD.) as cationic colloidal particles and 10 parts of the same latex as in Example 4 as a binder. After the solid content of the coating composition had been adjusted to 10%, the coating composition was coated by means of an air knife coater so that the dry coated amount would be 3 g/m$^2$, dried and then subjected to calender treatment under the same conditions as in Example 1, to obtain an ink jet recording sheet, Example 14.

EXAMPLE 15

An ink-receiving layer was formed in the same manner as in Example 14.

Coating of a gloss-providing layer

A gloss-providing layer was formed on the surface of the ink-receiving layer. The coating composition for the gloss-providing layer was prepared by using 100 parts of colloidal particles which are particles of colloidal silica having surfaces coated with alumina (ST-AK: manufactured by NISSAN CHEMICAL INDUSTRIES, LTD.) as cationic colloidal particles and 10 parts of the binder used in Example 4. After the solid content of the coating composition had been adjusted to 10%, the coating composition was coated so that the dry coated amount would be 3 g/m$^2$ under the same coating conditions as in Example 14. Then, it was dried and subjected to calender treatment under the same conditions for drying and calender treatment as in Example 14, to obtain an ink jet recording sheet, Example 15.

EXAMPLE 16

Coating of an ink-receiving layer

An ink-receiving layer was formed on the surface of a support. The coating composition for the ink-receiving layer was prepared by adding 7 parts of a commercially available styrene-butadiene-type latex to a pigment slurry with a solid content of 70% comprising 100 parts of kaolin having 73.3 vol % of particles having a particle size of at most 1.0 μm (Amazon 88: manufactured by Caulim da Amasonia) and 0.2 part of a commercially available polyacrylic acid-type dispersant and then adjusting the pH to 9.5 and the solid content to 60%. The coating composition was coated by means of a blade coater so that the dry coated amount would be 15 g/m$^2$ and dried.

Coating of a gloss-providing layer

On the ink-receiving layer, the same coating composition as in Example 14 was coated, dried and subjected to calender treatment under the same conditions for coating, drying and calender treatment as in Example 14, to obtain an ink jet recording sheet, Example 16.

EXAMPLE 17

Coating of an ink-receiving layer

An ink-receiving layer was formed on the surface of a support. The coating composition for the ink-receiving layer was prepared by adding 7 parts of a commercially available styrene-butadiene-type latex to 100 parts of a polystyrene-type organic pigment having 100 vol % of particles having a particle size of at most 1.0 μm (L8999: manufactured by Asahi Chemical Industry Co., Ltd.) and then adjusting the pH to 9.5 and the solid content to 45%. The coating composition was coated by means of an air knife coater so that the dry coated amount would be 15 g/m$^2$ and then dried.

Coating of a gloss-providing layer

On the surface of the ink-receiving layer, the same coating composition for the gloss-providing layer as in Example 14 was coated, dried and then subjected to calender treatment under the same conditions for coating, drying and calender treatment as in Example 14, to obtain an ink jet recording sheet, Example 17.

EXAMPLE 18

Coating of an ink-receiving layer

An ink-receiving layer was formed on the surface of a support. To 100 parts of heavy calcium carbonate (Escalon #1500: manufactured by SANKYO SEIFUN CO., LTD.), 1 part of a commercially available polyacrylic acid-type dispersant was added to obtain a slurry. The slurry was passed through a grinder (Universal Mill: manufactured by Mitsui Miike K.K.) twice, to obtain a ground pigment having 48.2 vol % of particles having a particle size of at most 1.0 μm. To 100 parts of this ground pigment, 5 parts of a commercially available styrene-butadiene-type latex was added, and the pH of the resulting mixture was adjusted to 9.5, and the solid content of the mixture was adjusted to 65%, to obtain a coating composition for the ink-receiving layer. The coating composition was coated by means of a blade coater so that the dry coated amount would be 15 g/m$^2$ and then dried.

Coating of a gloss-providing layer

On the surface of the ink-receiving layer, the same coating composition for the gloss-providing layer as in Example 14 was coated under the same coating conditions as in Example 14. Then, it was dried and subjected to calender treatment under the same conditions for drying and calender treatment as in Example 14, to obtain an ink jet recording sheet, Example 18.

EXAMPLE 19

An ink-receiving layer was formed in the same manner as in Example 14.

Coating of a gloss-providing layer

The same coating composition for the gloss-providing layer as in Example 14 except that 20 parts of a cationic dye-fixing agent (Sumirez resin 1001: manufactured by SUMITOMO CHEMICAL CO., LTD.) was further added, was coated on the ink-receiving layer in the same manner as in Example 14, and then it was dried and subjected to calender treatment under the same conditions for drying and calender treatment, to obtain an ink jet recording sheet, Example 19.

EXAMPLE 20

An ink-receiving layer was formed in the same manner as in Example 14.

Coating of a gloss-providing layer

The coating composition for the gloss-providing layer was prepared by using 100 parts of colloidal silica (Snowtex 40: manufactured by NISSAN CHEMICAL INDUSTRIES, LTD.) as anionic colloidal particles and 5 parts of the same latex as in Example 1 as a binder. After the solid content of the coating composition had been adjusted to 40%, the coating composition was coated so that the dry coated amount would be 5 g/m$^2$ in the same manner as in Example 17. Then it was dried and subjected to calender treatment under the same conditions for drying and calender treatment as in Example 17, to obtain an ink jet recording sheet, Example 20.

EXAMPLE 21

Coating of an ink-receiving layer

An ink-receiving layer was formed on the surface of a support. The coating composition for the ink-receiving layer was prepared by adding 7 parts of a commercially available styrene-butadiene-type latex to a pigment slurry with a solid content of 70% comprising 100 parts of kaolin having 12.3 vol % of particles having a particle size of at most 1.0 μm (Hydrasperse: manufactured by J. M. HUBER CORPORATION) and 0.1 part of a commercially available polyacrylic acid-type dispersant and then adjusting the pH to 9.5 and the solid content to 60%. The coating composition was coated by means of a blade coater so that the dry coated amount would be 20 g/m$^2$ and then dried.

Coating of a gloss-providing layer

A gloss-providing layer was formed on the surface of the ink-receiving layer. The same coating composition for the gloss-providing layer as in Example 14 was coated on the ink-receiving layer under the same conditions as in Example 14, to obtain an ink jet recording sheet, Example 21.

TABLE 4

| Example or Comparative Example | 75° Specular gloss (%) | Ink absorptivity | Printed image density |
|---|---|---|---|
| Example 14 | 53 | B | 1.52 |
| Example 15 | 49 | B | 1.49 |
| Example 16 | 62 | A | 1.55 |
| Example 17 | 68 | A | 1.56 |
| Example 18 | 56 | A | 1.53 |
| Example 19 | 55 | B | 1.61 |
| Example 20 | 30 | B | 1.30 |
| Example 21 | 36 | B | 1.45 |

From Table 4, it is clear that in Examples 14 to 19, wherein the gloss-providing layer contains cationic colloidal particles and the ink-receiving layers contain pigments having at least 30 vol % of particles having a particle size of at most 1.0 μm, a high printed image density and a high gloss were attained. Particularly, Examples 16 to 18 are excellent in ink absorptivity. With respect to Example 20 in which anionic colloidal particles were used for the gloss-providing layer, and with respect to Example 21 wherein a pigment having 12.3 vol % of particles having a particle size of at most 1.0 μm for the ink-receiving layer, the gloss was slightly poor.

EXAMPLE 22

An ink-receiving layer was formed in the same manner as in Example 21.

Coating of a gloss-providing layer

A gloss-providing layer was formed on the surface of the ink-receiving layer. The coating composition for the gloss-providing layer was prepared by using 90 parts of colloidal silica having a particle size of 100 nm (PST-1: manufactured by NISSAN CHEMICAL INDUSTRIES, LTD.) and 10 parts of colloidal silica having a-particle size of 15 nm (Snowtex 40: manufactured by NISSAN CHEMICAL INDUSTRIES, LTD.) as a pigment, 5 parts of the same latex as in Example 1 as a binder and 0.2 part of a thickener of polyacrylic acid-type (Modicol VD: manufactured SAN NOPCO LIMITED) so that the solid content would be 20%. The coating composition was coated on the surface of the ink-receiving layer by means of an air knife coater so that the dry coated amount would be 10 g/m$^2$ dried and then subjected to supercalender treatment under the same conditions as in Example 1, to obtain an ink jet recording sheet, Example 22.

EXAMPLE 23

An ink-receiving layer was formed in the same manner as in Example 1.

Coating of a gloss-providing layer

A gloss-providing layer was formed on the surface of the ink-receiving layer. The coating composition for the gloss-providing layer was prepared by using 100 parts of colloidal silica having a particle size of 40 nm (Snowtex XL: manufactured by NISSAN CHEMICAL INDUSTRIES, LTD.) as a pigment and 5 parts of the same synthetic polymer latex as in Example 1 so that the solid content would be 40%. The coating composition was coated on the surface of the ink-receiving layer so that the dry coated amount would be 10 g/m$^2$, dried and then subjected to supercalender treatment under the same conditions as in Example 1, to obtain an ink jet recording sheet, Example 23.

Comparative Example 4

An ink-receiving layer was formed in the same manner as in Example 1.

Coating of a gloss-providing layer

A gloss-providing layer was formed on the surface of the ink-receiving layer. The coating composition for the gloss-providing layer was prepared by using 100 parts of colloidal silica having a particle size of 60 nm ((Snowtex YL: manufactured by NISSAN CHEMICAL INDUSTRIES, LTD.) as a pigment. The coating composition was coated on the ink-receiving layer by means of an air knife coater so that the dry coated amount would be 10 g/m$^2$, dried and then subjected to supercalender treatment under the same conditions as in Example 1, to obtain an ink jet recording sheet, Comparative Example 4.

Comparative Example 5

An ink-receiving layer was formed in the same manner as in Example 1.

Coating of a gloss-providing layer

A gloss-providing layer was formed on the surface of the ink-receiving layer. The coating composition for the gloss-providing layer which comprises 100 parts of colloidal silica having a particle size of 65 nm (Snowtex YL: manufactured by NISSAN CHEMICAL INDUSTRIES, LTD.) as a pigment and 3 parts of polyvinyl alcohol (PVA117: manufactured by Kuraray Co., Ltd.) as a binder was coated on the surface of the ink-receiving layer by means of an air knife coater so that the dry coated amount would be 10 g/m$^2$ and then dried. Then it was subjected to supercalender treatment under the same conditions as in Example 1, to obtain an ink jet recording sheet, Comparative Example 5.

Comparative Example 6

An ink-receiving layer and a gloss-providing layer were formed in the same manner as in Comparative Example 5, except that the linear pressure at the time of the supercalender treatment was changed to 250 kg/cm, to obtain an ink jet recoding sheet, Comparative Example 6.

TABLE 5

| Example or Comparative Example | 75° Specular gloss (%) | | Ink absorptivity | Printed image density | Folding strength |
|---|---|---|---|---|---|
| | Not calender-treated | Calender-treated | | | |
| Example 3 | 30 | 49 | A | 1.45 | A |
| Example 2 | 45 | 68 | A | 1.29 | B |
| Example 22 | 39 | 59 | A | 1.29 | B |
| Example 23 | 26 | 45 | A | 1.55 | A |
| Comparative Example 4 | 31 | 57 | A | 1.49 | C |
| Comparative Example 5 | 9 | 15 | A | 1.46 | A |
| Comparative Example 6 | 9 | 26 | C | 1.47 | A |

From Table 5, it is clear that in Examples 2, 3, 22 and 23, an ink jet recording sheets having gloss comparable to that of commercially available art coated paper can be obtained by using colloidal particles having a specific particle size and a synthetic polymer latex in the coating composition for the gloss-providing layer, and that Comparative Examples 4 in which no synthetic polymer latex was used, is problematic in respect of folding strength. However, in Comparative Examples 5 and wherein an emulsified water-soluble polymer binder such as polyvinyl alcohol was used, the gloss was low, and even if severer conditions for calender treatment were employed in order to improve the gloss, the gloss was not so improved and the ink absorptivity was lowered.

EXAMPLES 24 to 30

Coating of ink-receiving layers

Ink-receiving layers were formed on the surfaces of supports. The coating composition for ink-receiving layers was prepared by using 100 parts of synthetic amorphous silica (Fine seal X37B: manufactured by Tokuyama Soda Co., Ltd.), 30 parts of polyvinyl alcohol (PVA117: manufactured by Kuraray Co., Ltd.), 30 parts of colloidal silica (Snowtex-O: manufactured by NISSAN CHEMICAL INDUSTRIES, LTD.) and 20 parts of a cationic dye-fixing agent (Sumirez resin 1001: manufactured by SUMITOMO CHEMICAL CO., LTD.) so that the solid content would be 15%. The coating composition was coated on supports by means of an air knife coater so that the dry coated amount will be 8 g/m$^2$ and then dried.

Coating of gloss-providing layers

Gloss-providing layers were formed on the surfaces of the ink-receiving layers. The coating composition for the gloss-providing layers were prepared by using 100 parts of colloidal silica having a particle size of 65 nm (Snowtex YL: manufactured by NISSAN CHEMICAL INDUSTRIES, LTD.) as a pigment and 5 parts of acrylic emulsions or styrene-butadiene-type latexes having particle sizes and glass transition temperatures shown in Table 6 as a synthetic polymer latex so that the solid contents would be 35%. The coating compositions were coated on the surfaces of the ink-receiving layers by means of an air knife coater so that the dry coated amounts would be 10 g/m$^2$ and the dried. Then, supercalender treatment was conducted under the conditions where the surface temperature of the chilled roll was 50° C. and the linear pressure was 100 kg/cm, so that the surfaces of the gloss-providing layers were brought to contact with the surface of the chilled roll.

TABLE 6

| Example or Comparative Example | Synthetic polymer latex | | |
|---|---|---|---|
| | Composition | Particle size (nm) | Tg (°C.) |
| Example 24 | Acrylic emulsion | 30 | −23 |
| Example 25 | Acrylic emulsion | 50 | −15 |
| Example 26 | Acrylic emulsion | 100 | −15 |
| Example 27 | Styrene.butadiene-type emulsion | 85 | +4 |
| Example 28 | Styrene.butadiene-type emulsion | 95 | +36 |
| Example 29 | Styrene.butadiene-type emulsion | 230 | +15 |
| Example 30 | Acrylic emulsion | 145 | +20 |

EXAMPLE 31

An ink-receiving layer was formed in the same manner as in Example 24.

Coating of a gloss-providing layer

A gloss-providing layer was formed on the surface of the ink-receiving layer. The coating composition for the gloss-providing layer was prepared in the same manner as in Example 24 except that an acrylic colloidal silica composite emulsion (Mowinyl 8020: manufactured by HOECHST GOSEI K.K.: particle size 40 nm, glass transition temperature −17° C.) was used as a synthetic polymer latex. The coating composition was coated, dried and subjected to calender treatment under the same conditions for coating, drying and calender treatment as in Example 24, to obtain an ink jet recording sheet, Example 31.

EXAMPLE 32

An ink-receiving layer was formed in the same manner as in Example 24.

Coating of a gloss-providing layer

A gloss-providing layer was formed on the surface of the ink-receiving layer. The synthetic polymer latex used in Example 30 and colloidal silica (Snowtex S: manufactured by NISSAN CHEMICAL INDUSTRIES, LTD.: particle size 8 nm) were mixed at a latex/colloidal silica weight ratio of 70/30. The coating composition for the gloss-providing layer was prepared by using 5 parts of this mixture and 100 parts of the colloidal particles used in Example 24 so that the solid content would be 35%. The coating composition was coated, dried and subjected to calender treatment under the same conditions as in Example 24, to obtain an ink jet recording sheet, Example 32.

Comparative Example 7

An ink-receiving layer was formed in the same manner as in Example 24. A gloss-providing layer was formed on the surface of the ink-receiving layer. The coating composition for the gloss-providing layer was the same as in Example 24 except that no synthetic polymer latex was incorporated. The coating composition was coated, dried and subjected to calender treatment under the same conditions as in Example 24, to obtain an ink jet recording sheet, Comparative Example 7.

TABLE 7

| Example or Comparative Example | 75° Specular gloss (%) | Ink absorptivity | Printed image density | Folding strength |
|---|---|---|---|---|
| Example 24 | 48 | A | 1.55 | A |
| Example 25 | 49 | A | 1.54 | A |
| Example 26 | 50 | A | 1.50 | A |
| Example 27 | 48 | A | 1.52 | A |
| Example 28 | 52 | A | 1.51 | B |
| Example 29 | 49 | A | 1.31 | B |
| Example 30 | 50 | A | 1.39 | B |
| Example 31 | 49 | A | 1.59 | A |
| Example 32 | 50 | A | 1.49 | B |
| Comparative Example 7 | 57 | A | 1.49 | C |

From Examples 23 to 32 shown in Table 7, it is evident that by using a synthetic polymer latex having a specific particle size, it is possible not only to provide a high gloss but also to attain a high ink absorptivity and a high printed image density. Further, from Examples 24, 31 and 32, it is clear that by the use of a colloidal silica composite emulsion, the printed image density is improved, that the separate use of colloidal silica having a particle size of less than 40 nm improves the gloss but results in a low printed image density, and that substantial decrease in the binder component lowers the folding strength. Further, from Example 28, it is clear that use of a synthetic polymer latex having a glass transition temperature higher than 30° C. tends to decrease the folding strength.

On the other hand, with respect to Comparative Example 7, which contains no synthetic polymer latex, the folding strength decrease to an unacceptable level, and with respect to Comparative Example 5, in which a non-emulsified polyvinyl alcohol was used as a binder, a high gloss was not obtained.

EXAMPLE 33

Coating of an ink-receiving layer

An ink-receiving layer was formed on the surface of a support. The coating composition for the ink-receiving layer was prepared by using 100 parts of synthetic amorphous silica (Fine seal X37B: manufactured by Tokuyama Soda Co., Ltd.), 30 parts of polyvinyl alcohol (PVA117: manufactured by Kuraray Co., Ltd.), 30 parts of colloidal silica (Snowtex-O: manufactured by NISSAN CHEMICAL INDUSTRIES, LTD.) and 20 parts of a cationic dye-fixing agent (Sumirez resin 1001: manufactured by SUMITOMO CHEMICAL CO., LTD.) so that the solid content would be 15%. The coating composition was coated on the support by means of an air knife coater so that the dry coated amount would be 8 g/m$^2$ and then dried.

Coating of a gloss-providing layer

A gloss-providing layer was formed by coating a composition for the gloss-providing layer on the surface of the ink-receiving layer followed by cast treatment.

The cast treatment was conducted by the direct method, and the coating composition for the gloss-providing layer was coated on the surface of the ink-receiving layer, and after 2 seconds, it was press-contacted a heated specular roll having a surface temperature of 90° C. and dried. The coating composition for the gloss-providing layer was prepared by using 100 parts of polystyrene-type organic particles (L8999: manufactured by Asahi Chemical Industry Co., Ltd.) having an average particle size of 200 nm as colloidal particles, 30 parts of a styrene-butadiene-type latex (0693: an average particle size 135 nm: manufactured by Japan Synthetic Rubber Co., Ltd.) as a binder and 2 parts of commercially available potassium oleate as a release agent so that the solid content would be 25%. The coating composition was coated on the surface of the ink-receiving layer by means of a roll coater so that the dry coated amount would be 3 g/m$^2$ and cast-treated as described above to obtain an ink jet recording sheet, Example 33.

EXAMPLE 34

A support and an ink-receiving layer were prepared in the same manner as in Example 33. The coating composition for a gloss-providing layer was prepared by using 100 parts of colloidal silica having an average particle size of 65 nm (Snowrex YL: manufactured by NISSAN CHEMICAL INDUSTRIES, LTD.) as colloidal particles and 20 parts of the same latex as in Example 33 as a binder so that the solid content would be 25%. The coating composition was coated on the surface of the ink-receiving layer by means of a roll coater so that the dry coated amount would be 5 g/m$^2$, and then it was subjected to cast treatment under the same conditions as in Example 33, to obtain an ink jet recording sheet, Example 34.

EXAMPLE 35

A support and an ink-receiving layer were prepared in the same manner as in Example 33. The coating composition for a gloss-providing layer was prepared by using 100 parts of colloidal silica having an average particle size of 40 nm (Snowtex YL: manufactured by NISSAN CHEMICAL INDUSTRIES, LTD.) as colloidal particles and 20 parts of the same latex as in Example 33 as a binder so that the solid content would be 20%. The coating composition was coated on the surface of the ink-receiving layer by means of a roll coater so that the dry coated amount would be 5 g/m$^2$ and then it was subjected to cast treatment under the same conditions as in Example 33, to obtain an ink jet recording sheet, Example 35.

EXAMPLE 36

A support and an ink-receiving layer were prepared in the same manner as in Example 33. The coating composition for a gloss-providing layer was prepared by using 100 parts of colloidal silica having an average particle size of 300 nm (PST-3: manufactured by NISSAN CHEMICAL INDUSTRIES, LTD.) as colloidal particles, 20 parts of the same latex as in Example 33 as a binder and 3 parts of a cationic dye-fixing agent (Polyfix 601: manufactured by SHOWA HIGHPOLYMER CO., LTD.) so that the solid content would be 20%. The coating composition was coated on the surface of the ink-receiving layer so that the dry coated amount would be 3 g/m$^2$, and then it was subjected to cast treatment under the same conditions as in Example 33, to obtain an ink jet recording sheet, Example 36.

EXAMPLE 37

A support and an ink-receiving layer were prepared in the same manner as in Example 33. The coating composition for a gloss-providing layer was prepared by using 100 parts of amorphous silica.alumina having a porous structure and an average particle size of 40 nm (USB-1: manufactured by CATALYST & CHEMICALS IND. CO., LTD.) as colloidal particles and 20 parts of the same latex as in Example 33 as a binder so that the solid content would be 20%. The coating composition was coated on the surface of the ink-receiving layer by means of a roll coater so that the dry coated amount would be 5 g/m$^2$, and then it was subjected to cast treatment under the same conditions as in Example 33, to obtain an ink jet recording sheet, Example 37.

EXAMPLE 38

A support and an ink-receiving layer were prepared in the same manner as in Example 33. The coating composition for a gloss-providing layer was prepared by using 100 parts of cationic colloidal silica having an average particle size of 80 nm (Snowtex AK-ZL: manufactured by NISSAN CHEMICAL INDUSTRIES, LTD.) as colloidal particles, 20 parts of commercially available nonionic acrylic emulsion as a binder and 5 parts of the same cationic dye-fixing agent as used in Example 36 so that the solid content would be 30%. The coating composition was coated on the surface of the ink-receiving layer by means of a roll coater so that the dry coated amount would be 8 g/m$^2$, and then it was subjected to cast treatment under the same conditions as in Example 33, to obtain an ink jet recording sheet, Example 38.

Comparative Example 8

A support was prepared in the same manner as in Example 33. On the surface of the support, the same coating composition for the gloss-providing layer as in Example 34 was coated by means of an air knife coater, without formation of an ink-receiving layer, so that the dry coated amount would be 10 g/m$^2$, and then it was subjected to cast treatment under the same conditions as in Example 33, to obtain an ink jet recording sheet, Comparative Example 8.

Comparative Example 9

A support was prepared in the same manner as in Example 33. On the surface of the support, the coating composition for an ink-receiving layer which had been prepared by adding 2 parts of commercially available potassium oleate to the same coating composition for the ink-receiving layer as in Example 33, was coated by means of an air knife coater so that the dry coated amount would be 15 g/m$^2$. Then, the resulting ink-receiving layer was subjected to cast treatment under the same conditions as in Example 33, to obtain an ink jet recording sheet, Comparative Example 9.

Comparative Example 10

A support and an ink-receiving layer were prepared in the same manner as in Example 33. The coating composition for a gloss-providing layer was prepared by using 100 parts of colloidal silica having an average particle size of 500 nm (PST-5: manufactured by NISSAN CHEMICAL INDUSTRIES, LTD.) as colloidal particles, 20 parts of the same latex as in Example 33 as a binder and 3 parts of a cationic dye-fixing agent (Polyfix 601: manufactured by SHOWA HIGHPOLYMER CO., LTD.) so that the solid content would be 20%. The coating composition was coated on the surface of the ink-receiving layer by means of a roll coater so that the dry coated amount would be 3 g/m$^2$ and then it was subjected to cast treatment under the same conditions as in Example 33, to obtain an ink jet recording sheet, Comparative Example 10.

TABLE 8

| Example or Comparative Example | 75° Specular gloss (%) | Ink absorptivity | Printed image density |
|---|---|---|---|
| Example 33 | 76 | A | 1.26 |
| Example 34 | 74 | A | 1.47 |
| Example 35 | 71 | A | 1.57 |
| Example 36 | 72 | A | 1.30 |
| Example 37 | 75 | A | 1.72 |
| Example 38 | 79 | A | 1.78 |
| Comparative Example 8 | 42 | C | 1.13 |
| Comparative Example 9 | 12 | A | 1.60 |
| Comparative Example 10 | 70 | A | 1.10 |

As is clear from Table 8, in Example 33 to 38, in which an ink-receiving layer and a gloss-providing layer formed from a coating composition composed mainly of colloidal particles having an average particle size of at most 300 nm were successively laminated on a support and the gloss-providing layer was subjected to cast treatment, ink jet recording sheets which had a gloss comparable to that of commercially available cast coated paper and were excellent in ink absorptivity and printed image density, were obtained. On the other hand, in Comparative Example 8, wherein no ink-receiving layer was formed, in Comparative Example 9 wherein no gloss-providing layer was formed, and in Comparative Example 10 wherein particles having an average particle size larger than 300 nm were used, the problems that the present invention is to solve were not solved.

EXAMPLE 39

A support and an ink-receiving layer were prepared in the same manner as in Example 33. The coating composition for a gloss-providing layer was prepared by using 100 parts of acrylic organic particles having an average particle size of 60 nm (Mowinyl 790: manufactured by HOECHST GOSEI K.K.) as colloidal particles, 20 parts of the same latex as used in Example 33 as a binder and 1 part of the same potassium oleate as used in Example 33 so that the solid content would be 40%. The coating composition was coated on the surface of the ink-receiving layer by means of an air knife coater so that the dry coated amount would be 10 g/m$^2$ and dried. Then, it was subjected to cast treatment by the re-wetting method at a specular roll temperature of 120° C., to obtain an ink jet recording sheet, Example 39.

EXAMPLE 40

A support and an ink-receiving layer were prepared in the same manner as in Example 33. The coating composition for a gloss-providing layer was prepared by using 90 parts of the organic particles used in Example 39 and 10 parts of colloidal silica having an average particle size of 40 nm (manufactured by NISSAN CHEMICAL INDUSTRIES, LTD.) as colloidal particles and 20 parts of the latex used in Example 33 as a binder so that the solid content would be 40%. The coating composition was coated on the surface of the ink-receiving layer by means of an air knife coater so that the dry coated amount would be 10 g/m$^2$ and dried. Then, it was subjected to cast treatment under the same conditions as in Example 39, to obtain an ink jet recording sheet, Example 40.

EXAMPLE 41

A support and an ink-receiving layer were prepared in the same manner as in Example 33. The coating composition for a gloss-providing layer was prepared by using 60 parts of the organic particles used in Example 39 and 40 parts of colloidal silica used in Example 40 as colloidal particles and 20 parts of the latex used in Example 33 as a binder so that the solid content would be 40%. The coating composition was coated on the surface of the ink-receiving layer by means of an air knife coater so that the dry coated amount would be 10 g/m$^2$ and dried. Then, it was subjected to cast treatment under the same conditions as in Example 39, to obtain an ink jet recording sheet, Example 41.

EXAMPLE 42

A support and an ink-receiving layer were prepared in the same manner as in Example 33. The coating composition for a gloss-providing layer was prepared by using 20 parts of the organic particles used in Example 39 and 80 parts of colloidal silica used in Example 40 as colloidal particles and 20 parts of the latex used in Example 33 as a binder so that the solid content would be 40%. The coating composition was coated on the surface of the ink-receiving layer by means of an air knife coater so that the dry coated amount would be 10 g/m$^2$ and dried. Then, cast treatment was conducted under the same conditions as in Example 39, to obtain an ink jet recording sheet, Example 42.

EXAMPLE 43

A support and an ink-receiving layer were prepared in the same manner as in Example 33. The coating composition for a gloss-providing layer was prepared by using 100 parts of the colloidal silica used in Example 40 as colloidal particles and 20 parts of the latex used in Example 33 as a binder so that the solid content would be 40%. The coating composition was coated on the surface of the ink-receiving layer by means of an air knife coater so that the dry coated amount would be 10 g/m$^2$ and dried. Then, cast treatment was conducted under the same conditions as in Example 39, to obtain an ink jet recording sheet, Example 43.

TABLE 9

| Example or Comparative Example | 75° Specular gloss (%) | Ink absorptivity | Printed image density |
|---|---|---|---|
| Example 39 | 86 | B | 1.52 |
| Example 40 | 85 | A | 1.53 |
| Example 41 | 83 | A | 1.55 |
| Example 42 | 76 | A | 1.56 |
| Example 43 | 73 | A | 1.58 |

From Table 9, it is clear that Examples 39 to 42, which were prepared by cast-treating gloss-providing layers comprising organic particles and colloidal silica, have high gloss. It is also clear that especially, when the organic particle/colloidal silica weight ratio is from 40/60 to 90/10, the ink-absorptivity is excellent while the gloss is higher than 80%.

EXAMPLE 44

A support and an ink-receiving layer were prepared in the same manner as in Example 33. The coating composition for a gloss-providing layer was prepared by using 100 parts of the organic particles used in Example 33 as colloidal particles, 30 parts of an acrylic synthetic polymer latex having an average particle size of 50 nm (SX984A11: manufactured by Japan Synthetic Rubber Co., Ltd.) and 1 part commercially available potassium oleate as a release agent so that the solid content would be 30%. The coating composition was coated on the surface of the ink-receiving layer by means of a roll coater so that the dry coated amount would be 3 g/m$^2$ and cast-treated under the same conditions as in Example 33, to obtain an ink jet recording sheet, Example 44.

EXAMPLE 45

A support and an ink-receiving layer were prepared in the same manner as in Example 33. The coating composition for a gloss-providing layer was prepared by using 100 parts of the organic particles used in Example 39 as colloidal particles, 20 parts of an acrylic synthetic polymer latex having the same composition as the latex used in Example 33 and having an average particle size of 100 nm as a binder and 1 part of the same release agent as in Example 33 so that the solid content would be 30%. The coating composition was coated on the surface of the ink-receiving layer by means of a roll coater so that the dry coated amount would be 5 g/m$^2$ and then cast-treated under the same conditions as in Example 33, to obtain an ink jet recording sheet, Example 45.

EXAMPLE 46

A support and an ink-receiving layer were prepared in the same manner as in Example 33. The coating composition for a gloss-providing layer was prepared by using 100 parts of colloidal silica having an average particle size of 80 nm (Snowtex ZL: manufactured by NISSAN CHEMICAL INDUSTRIES, LTD.) as colloidal particles, 20 parts of a styrene-butadiene-type synthetic polymer latex having an average particle size of 80 nm as a binder and 2 parts of the same release agent as in Example 33 so that the solid content would be 30%. The coating composition was coated on the surface of the ink-receiving layer so that the dry coated amount would be 5 g/m$^2$ and then cast-treated under the same conditions as in Example 33, to obtain an ink jet recording sheet, Example 46.

EXAMPLE 47

A support and an ink-receiving layer were prepared in the same manner as in Example 33. The coating composition for a gloss-providing layer was prepared by using 100 parts of the colloidal silica having an average particle size of 100 nm (PST-1: manufactured by NISSAN CHEMICAL INDUSTRIES, LTD.) as colloidal particles and 25 parts of the same latex as in Example 44 as a binder so that the solid content would be 20%. The coating composition was coated on the surface of the ink-receiving layer by means of a roll coater so that the dry coated amount would be 2 g/m$^2$ and then cast-treated under the same conditions as in Example 33, to obtain an ink jet recording sheet, Example 47.

EXAMPLE 48

A support and an ink-receiving layer were prepared in the same manner as in Example 33. The coating composition for a gloss-providing layer was prepared in accordance with the same formulation as in Example 46 except that the synthetic polymer latex used in Example 6 was replaced with a colloidal silica composite emulsion having an average particle size of 60 nm (Mowinyl 8030: manufactured by HOECHST GOSEI K.K.) so that the solid content would be 30%. The coating composition was coated on the surface of the ink-receiving layer by a roll coater so that the dry coated amount would be 5 g/m$^2$ and then cast-treated under the same conditions as in Example 33, to obtain an ink jet recording sheet, Example 48.

TABLE 10

| Example or Comparative Example | 75° Specular gloss (%) | Ink absorptivity | Printed image density |
|---|---|---|---|
| Example 44 | 80 | A | 1.42 |
| Example 45 | 73 | A | 1.62 |
| Example 46 | 76 | A | 1.51 |
| Example 47 | 78 | A | 1.49 |
| Example 48 | 76 | A | 1.60 |
| Example 33 | 76 | A | 1.26 |
| Example 36 | 72 | A | 1.30 |
| Comparative Example 10 | 70 | A | 1.10 |

As is clear from Table 10, by using colloidal particles having an average particle size of at most 300 nm and a synthetic polymer latex in the coating composition for the gloss-providing layer, the objects of the present invention can be attained. Particularly, with respect to Examples 44 to 48 wherein the average particle sizes of the latexes are at most 100 nm, decrease in ink absorptivity is small, and with respect to Example 48, wherein the latex is a colloidal silica composite emulsion, decrease in ink absorptivity is still smaller.

EXAMPLE 49

A support and an ink-receiving layer were prepared in the same manner as in Example 33. The coating composition for a gloss-providing layer was prepared by using 100 parts of the colloidal silica used in Example 36 as colloidal particles, 20 parts of the latex used in Example 33 as a binder and 3 parts of casein (made in New Zealand) as an ampholite so that the solid content would be 20%. The coating composition was coated on the surface of the ink-receiving layer by means of a roll coater so that the dry coated amount would be 3 g/m$^2$ and then cast-treated under the same conditions as in Example 33, to obtain an ink jet recording sheet, Example 49.

EXAMPLE 50

A support and an ink-receiving layer were prepared in the same manner as in Example 33. The coating composition for a gloss-providing layer was prepared in accordance with the same formulation as in Example 41 except for addition of 0.5 part of the same ampholite as in Example 49, so that the solid content would be 40%. The coating composition was coated on the surface of the ink-receiving layer by means of an air knife coater so that the dry coated amount would be 10 g/m$^2$ and then cast-treated under the same conditions as in Example 41, to obtain an ink jet recording sheet, Example 50.

EXAMPLE 51

A support and an ink-receiving layer were prepared in the same manner as in Example 33. The coating composition for a gloss-providing layer was prepared in accordance with the the same formulation as in Example 35 except for addition of 3 parts of the same ampholite as in Example 49, so that the solid content would be 40%. The coating composition was coated on the surface of the ink-receiving layer by means of a roll coater so that the dry coated amount would be 5 g/m$^2$ and then cast-treated under the same conditions as in Example 35, to obtain an ink jet recording sheet, Example 51.

EXAMPLE 52

A support and an ink-receiving layer were prepared in the same manner as in Example 33. The coating composition for a gloss-providing layer was prepared in accordance with the same formulation as in Example 35 except for addition of 2 parts of commercially available aluminum hydroxide as an ampholite, so that the solid content would be 35%. The coating composition was coated on the surface of the ink-receiving layer by means of a roll coater so that the dry coated amount would be 5 g/m$^2$ and then cast-treated under the same conditions as in Example 35, to obtain an ink jet recording sheet, Example 52.

Comparative Example 11

A support and an ink-receiving layer were prepared in the same manner as in Example 33. The coating composition for a gloss-providing layer was prepared in accordance with the same formulation as in Comparative Example 10 except for addition of 3 parts of the same ampholite as in Example 49, so that the solid content would be 20%. The coating composition was coated on the surface of the ink-receiving layer by means of a roll coater so that the dry coated amount would be 5 g/m$^2$ and then cast-treated under the same conditions as in Comparative Example 10, to obtain an ink jet recording sheet, Comparative Example 11.

TABLE 11

| Example or Comparative Example | 75° Specular gloss (%) | Ink absorptivity | Printed image density |
|---|---|---|---|
| Example 49 | 78 | A | 1.38 |
| Example 36 | 72 | A | 1.30 |
| Example 50 | 85 | A | 1.60 |
| Example 41 | 83 | A | 1.55 |
| Example 51 | 79 | A | 1.68 |
| Example 52 | 76 | A | 1.61 |
| Example 35 | 71 | A | 1.57 |
| Comparative Example 11 | 72 | A | 1.12 |
| Comparative Example 10 | 70 | A | 1.10 |

It is clear from Table 11 that in Examples 49 to 52 wherein ampholites were added, the gloss and the printed image density were improved. However, with respect to Comparative Example 11 wherein colloidal particles having an average particle size larger than 300 nm were used, although slight improvement in gloss and printed image density can be recognized, the effect of the ampholite on printed image density is small due to high opaqueness of the gloss-providing layer.

EXAMPLE 53

A support and an ink-receiving layer were prepared in the same manner as in Example 33. The coating composition for a gloss-providing layer was prepared in accordance with the same formulation as in Example 36 except for addition of 2 parts of smectite (SWN: manufactured by CO-OP CHEMICAL CO., LTD.), so that the solid content would be 18%. The coating composition was coated on the surface of the ink-receiving layer by means of a roll coater so that the dry coated amount would be 3 g/m$^2$ and then cast-treated under the same conditions as in Example 33, to obtain an ink jet recording sheet, Example 53.

EXAMPLE 54

A support and an ink-receiving layer were prepared in the same manner as in Example 33. The coating composition for a gloss-providing layer was prepared in accordance with the same formulation as in Example 41 except for addition of 2 parts of the same smectite as in Example 53, so that the solid content would be 35%. The coating composition was coated on the surface of the ink-receiving layer by means of an air knife coater so that the dry coated amount would be 10 g/m$^2$ and then cast-treated under the same conditions as in Example 41, to obtain an ink jet recording sheet, Example 54.

EXAMPLE 55

A support and an ink-receiving layer were prepared in the same manner as in Example 33. The coating composition for a gloss-providing layer was prepared in accordance with the same formulation as in Example 34 except for addition of 2 parts of the same smectite as in Example 53, so that the solid content would be 25%. The coating composition was coated on the surface of the ink-receiving layer by means of a roll coater so that the dry coated amount would be 5 g/m$^2$ and then cast-treated in the same manner as in Example 34, to obtain an ink jet recording sheet, Example 55.

EXAMPLE 56

A support and an ink-receiving layer were prepared in the same manner as in Example 33. The coating composition for a gloss-providing layer was prepared in accordance with the same formulation as in Example 34 except for addition of 2 parts of a polycarboxylic acid-type humectant (Modicol VD: manufactured SAN NOPCO LIMITED), so that the solid content would be 25%. The coating composition was coated on the surface of the ink-receiving layer by means of a roll coater so that the dry coated amount would be 5 g/m$^2$ and then cast-treated under the same conditions as in Example 34, to obtain an ink jet recording sheet, Example 56.

Comparative Example 12

A support and an ink-receiving layer were prepared in the same manner as in Example 33. The coating composition for a gloss-providing layer was prepared in accordance with the same formulation as in Comparative Example 10 except for addition of 2 parts of the same smectite as in Example 53, so that the solid content would be 15%. The coating composition was coated on the surface of the ink-receiving layer by means of a roll coater so that the dry coated amount would be 5 g/m$^2$ and then cast-treated under the same conditions as in Comparative Example 10, to obtain an ink jet recording sheet, Comparative Example 12.

TABLE 12

| Example or Comparative Example | 75° Specular gloss (%) | Ink absorptivity | Printed image density |
|---|---|---|---|
| Example 53 | 81 | A | 1.29 |
| Example 36 | 72 | A | 1.30 |
| Example 54 | 89 | A | 1.53 |
| Example 41 | 83 | A | 1.55 |
| Example 55 | 83 | A | 1.45 |
| Example 56 | 79 | B | 1.31 |
| Example 34 | 74 | A | 1.47 |
| Comparative Example 12 | 72 | A | 1.08 |
| Comparative Example 9 | 70 | A | 1.10 |

EXAMPLE 57

Coating of an ink-receiving layer

An ink-receiving layer was formed on a support. The coating composition of the ink-receiving layer was prepared by adding 7 parts of a commercially available styrene-butadiene-type latex to a pigment slurry having a solid content of 70% which comprises 100 parts of kaolin having at least 30.2 vol % of particles having a particle size of at most 1.0 μm (Ultrawhite 90: manufactured by ENGELHARD CORPORATION) and 0.1 part of a commercially available polyacrylic acid-type dispersant and then adjusting the pH to 9.5 and the solid content to 60%. The coating composition was coated by means of a blade coater so that the dry coated amount would be 15 g/m$^2$ and then dried.

Coating of a gloss-providing layer

A gloss-providing layer was formed on the surface of the ink-receiving layer and then cast-treated. The same coating composition for the gloss-providing layer as in Example 38 was used, and the cast treatment was conducted in the same manner as in Example 38, to obtain an ink jet recording sheet, Example 57.

EXAMPLE 58

Coating of an ink-receiving layer

An ink-receiving layer was formed on a support. The coating composition for the ink-receiving layer was prepared by adding 7 parts of a commercially available styrene.butadiene-type latex to a pigment slurry having a solid content of 70% which comprises 100 parts of kaolin having at least 73.3 vol % of particles having a particle size of at most 1.0 μm (Amazon 88: manufactured by Caulim da Amasonia) and 0.2 part of a commercially available polyacrylic acid-type dispersant and then adjusting the pH to 9.5 and the solid content to 60%. The coating composition was coated by means of a blade coater so that the dry coated amount would be 15 g/m$^2$ and then dried.

Coating of a gloss-providing layer

A gloss-providing layer was formed on the surface of the ink-receiving layer and cast-treated. The same coating composition for the gloss-providing layer as in Example 38 was used, and the cast treatment was conducted in the same manner as in Example 38, to obtain an ink jet recording sheet, Example 58.

EXAMPLE 59

Coating of an ink-receiving layer

An ink-receiving layer was formed on a support. The coating composition for the ink-receiving layer was prepared by adding 7 parts of a commercially available styrene.butadiene-type latex to 100 parts of organic particles having 100 vol % of particles having a particle size of at most 1.0 μm (L8999: manufactured by Asahi Chemical Industry Co., Ltd.) and then adjusting the pH to 9.5 and the solid content to 45%. The coating composition was coated by means of a blade coater so that the dry coated amount would be 15 g/m$^2$ and then dried.

Coating of a gloss-providing layer

A gloss-providing layer was formed on the surface of the ink-receiving layer and cast-treated. The same coating composition for the gloss-providing layer as in Example 38 was used, and the cast treatment was conducted in the same manner as in Example 38, to obtain an ink jet recording sheet, Example 59.

EXAMPLE 60

Coating of an ink-receiving layer

An ink-receiving layer was formed on the surface of a support. To 100 parts of heavy calcium carbonate (Escalon #1500: manufactured by SANKYO SEIFUN CO., LTD.), 1 part of a commercially available polyacrylic acid-type dispersant was added to obtain a slurry. The slurry was passed through a grinder (Universal Mill: manufactured by Mitsui Miike K.K.) twice, to obtain a ground pigment having 48.2 vol % of particles having a particle size of at most 1.0 μm. To 100 parts of this ground pigment, 5 parts of a commercially available styrene-butadiene-type latex was added, and the pH of the resulting mixture was adjusted to 9.5, and the solid content of the mixture was adjusted to 65%, to obtain a coating composition for the ink-receiving layer. The coating composition was coated by means of a blade coater so that the dry coated amount would be 15 g/m$^2$ and then dried.

Coating of a gloss-providing layer

A gloss-providing layer was formed on the surface of the ink-receiving layer and cast-treated. The same coating composition for the gloss-providing layer as in Example 38 was used, and the cast treatment was conducted in the same manner as in Example 38, to obtain an ink jet recording sheet, Example 60.

EXAMPLE 61

Coating of an ink-receiving layer

An ink-receiving layer was formed on the surface of a support. The coating composition for the ink-receiving layer was prepared by adding 7 parts of a commercially available styrene-butadiene-type latex to a pigment slurry comprising 100 parts of kaolin having 12.3 vol % of particles having a particle size of at most 1.0 μm (Hydrasperse: manufactured by J. M. HUBER CORPORATION) and 0.1 part of a commercially available polyacrylic acid-type dispersant and then adjusting the pH to 9.5 and the solid content to 60%. The coating composition was coated by means of a blade coater so that the dry coated amount would be 20 g/m$^2$ and then dried.

Coating of a gloss-providing layer

A gloss-providing layer was formed on the surface of the ink-receiving layer and cast-treated. The same coating composition for the gloss-providing layer as in Example 38 was used, and the cast treatment was conducted in the same manner as in Example 38, to obtain an ink jet recording sheet, Example 61.

EXAMPLE 62

A support and an ink-receiving layer were prepared in the same manner as in Example 57. The same coating composition for a gloss-providing layer as in Example 36 was coated and cast-treated under the same conditions as in Example 36, to obtain an ink jet recording sheet, Example 62.

EXAMPLE 63

Coating of an ink-receiving layer

An ink-receiving layer was formed on a support. The coating composition for the ink-receiving layer was prepared by using 100 parts of an alumina sol (non-spherical particles; particle size 100 nm×10 nm; Cataloid AS-3: manufactured by CATALYST & CHEMICALS IND. CO., LTD.) as cationic colloidal particles and 10 parts of polyvinyl alcohol (PVA117: manufactured by Kuraray Co., Ltd.) as a binder so that the solid content would be 10%. The coating composition was coated by means of a roll coater so that the dry coated amount would be 1 g/m$^2$ and then dried.

Coating of a gloss-providing layer

A gloss-providing layer was formed on the surface of the ink-receiving layer and cast-treated. The same coating composition for the gloss-providing layer as in Example 36 was used, and the cast treatment was conducted in the same manner as in Example 36, to obtain an ink jet recording sheet, Example 63.

EXAMPLE 64

Coating of ink-receiving layers

Two ink-receiving layers were formed on a support. Ink-receiving layer A was formed on the support and then ink-receiving layer B was formed on the ink-receiving layer A as follows.

Ink-receiving layer A was formed by using the same coating composition as for the ink-receiving layer in Example 57, in the same manner as for the ink-receiving layer in Example 57. Then, on the ink-receiving layer A thus obtained, ink-receiving layer B was formed. Ink-receiving layer B was formed by coating the same coating composition as for the ink-receiving layer in Example 64 in the same manner as for the ink-receiving layer in Example 64.

Coating of a gloss-providing layer

A gloss-providing layer was formed on ink-receiving layers A and B which had been successively laminated on the support and then cast-treated. The same coating composition as for the gloss-providing layer in Example 36 was coated and cast-treated under the same conditions as in Example 36, to obtain an ink jet recording sheet, Example 64.

Comparative Example 13

Ink-receiving layers were formed by coating the same coating compositions in the same manner as for the ink-receiving layers in Example 64 and then dried. The same coating composition for a gloss-providing layer as in Comparative Example 10 was coated on the ink-receiving layers and cast-treated under the same conditions as in Comparative Example 10, to obtain an ink jet recording sheet, Comparative Example 13.

TABLE 13

| Example or Comparative Example | 75° Specular gloss (%) | Ink absorptivity | Printed image density |
|---|---|---|---|
| Example 57 | 88 | B | 1.60 |
| Example 58 | 85 | A | 1.62 |
| Example 59 | 83 | A | 1.63 |
| Example 60 | 84 | A | 1.64 |
| Example 61 | 89 | B | 1.55 |
| Example 62 | 80 | B | 1.27 |
| Example 63 | 75 | B | 1.35 |
| Example 64 | 90 | A | 1.36 |
| Example 36 | 72 | A | 1.30 |
| Example 38 | 79 | A | 1.78 |
| Comparative Example 13 | 88 | A | 1.13 |
| Comparative example 10 | 70 | A | 1.10 |

It is clear from Table 13 that by using colloidal particles having an average particle size of at most 300 nm for the gloss-providing layer and using a pigment having at least 30 vol % of particles having a particle size of at most 1.0 μm in the ink-receiving layer, the objects of the present invention can be attained, and when a pigment out of this range is used, deterioration in ink absorptivity is observed. It is also clear from Examples 36, 63 and 64 that use of cationic colloidal particles in the ink-receiving layer improves printed image density. Further, by providing two ink-receiving layers and using cationic colloidal particles in the ink-receiving layer adjacent to the gloss-providing layer, the gloss is improved.

EXAMPLE 65

A support and an ink-receiving layer were prepared in the same manner as in Example 57. The same coating composition as for the gloss-providing layer in Example 57 was coated by means of an air knife coater so that the dry coated amount would be 8 g/m$^2$ and dried. The resulting gloss-providing layer was cast-treated by the re-wet method by re-wetting it and then press contacting it to a specular roll having a surface temperature of 120° C., to obtain an ink jet recording sheet, Example 65.

EXAMPLE 66

A support and an ink-receiving layer were prepared in the same manner as in Example 58. The same coating composition as for the gloss-providing layer in Example 58 was coated by means of an air knife coater so that the dry coated amount would be 8 g/m$^2$ and dried. The resulting gloss-providing layer was cast-treated by the re-wet method by re-wetting it and then press contacting it to a specular roll having a surface temperature of 120° C., to obtain an ink jet recording sheet, Example 66.

EXAMPLE 67

A support and an ink-receiving layer were prepared in the same manner as in Example 59. The same coating composition as for the gloss-providing layer in Example 59 was coated by means of an air knife coater so that the dry coated amount would be 8 g/m$^2$ and dried. The resulting gloss-providing layer was cast-treated by the re-wet method by re-wetting it and then press contacting it to a specular roll having a surface temperature of 120° C. to obtain an ink jet recording sheet, Example 67.

EXAMPLE 68

A support and an ink-receiving layer were prepared in the same manner as in Example 60. The same coating composition as for the gloss-providing layer in Example 60 was coated by means of an air knife coater so that the dry coated amount would be 8 g/m$^2$ and dried. The resulting gloss-providing layer was cast-treated by the re-wet method by re-wetting it and then press contacting it to a specular roll having a surface temperature of 120° C., to obtain an ink jet recording sheet, Example 68.

EXAMPLE 69

A support and an ink-receiving layer were prepared in the same manner as in Example 33. The same coating composition as for the gloss-providing layer in Example 41 was coated by means of a roll coater so that the dry coated amount would be 5 g/m$^2$. The resulting gloss-providing layer was cast-treated by the direct method by press contacting it to a specular roll having a surface temperature of 90° C., to obtain an ink jet recording sheet, Example 69.

EXAMPLE 70

A support and an ink-receiving layer were prepared in the same manner as in Example 33. The same coating composition as for the gloss-providing layer in Example 36 was coated by means of an air knife coater so that the dry coated amount would be 8 g/m$^2$ and dried. The resulting gloss-providing layer was cast-treated by the re-wet method by re-wetting it and then press contacting it to a specular roll having a surface temperature of 120° C., to obtain an ink jet recording sheet, Example 70.

Comparative Example 14

A support and an ink-receiving layer were prepared in the same manner as in Example 33. The same coating composition as for the gloss-providing layer in Comparative Example 10 was coated by means of a roll coater so that the dry coated amount would be 5 g/m$^2$ and dried. The resulting gloss-providing layer was cast-treated by the re-wet method by re-wetting it and then press contacting it to a specular roll having a surface temperature of 120° C., to obtain an ink jet recording sheet, Comparative Example 14.

TABLE 14

| Example or Comparative Example | Method of cast treatment | 75° Specular gloss (%) | Ink absorptivity | Printed image density |
|---|---|---|---|---|
| Example 57 | Direct method | 88 | B | 1.60 |
| Example 58 | Direct method | 85 | A | 1.62 |
| Example 59 | Direct method | 83 | A | 1.63 |
| Example 60 | Direct method | 84 | A | 1.64 |
| Example 65 | Re-wet method | 76 | B | 1.55 |
| Example 66 | Re-wet method | 75 | A | 1.57 |
| Example 67 | Re-wet method | 73 | A | 1.58 |
| Example 68 | Re-wet method | 72 | A | 1.60 |
| Example 69 | Direct method | 90 | A | 1.59 |
| Example 41 | Re-wet method | 83 | A | 1.55 |
| Example 36 | Direct method | 72 | A | 1.30 |
| Example 70 | Re-wet method | 70 | A | 1.28 |
| Comparative Example 10 | Direct method | 70 | A | 1.10 |
| Comparative Example 14 | Re-wet method | 65 | A | 1.07 |

From Table 14, it is clear that by cast treatment by the direct method, it is possible to obtain an ink jet recording sheet having a high gloss. It is also clear that in the case of the direct method, even if the coated amount of the gloss-providing layer is decreased, the gloss is high, and as a result, development of opaqueness is suppressed, thereby the printed image density is high.

EXAMPLE 71

Coating of an ink-receiving layer

The coating composition for an ink-receiving layer prepared in accordance with the following formulation (solid content 15%) was coated on a support by means of an air knife coater so that the dry coated amount would be 8 g/m$^2$ and then dried, to form an ink-receiving layer.

Synthetic amorphous silica (Fine seal X37B: manufactured by Tokuyama Soda. Co., Ltd.) 100 parts Polyvinyl alcohol (PVA117: manufactured by Kuraray Co., Ltd.) 30 parts Colloidal silica (Snowtex-0: manufactured by NISSAN CHEMICAL INDUSTRIES, LTD.) 30 parts Cationic dye-fixing agent (Sumirez resin 1001; manufactured by SUMITOMO CHEMICAL CO., LTD.) 20 parts Preparation of the coating composition for a gloss-providing layer The coating composition for a gloss-providing layer was prepared in accordance with the following formulation so that the solid content would be 40%.

| | |
|---|---|
| Acrylic organic particles having an average particle size of 60 nm (Mowinyl 790: manufactured by HOECHST GOSEI K.K.) | 80 parts |
| Colloidal silica having an average particle size of 40 nm (manufactured by Nissan Chemical Industries, Ltd). | 20 parts |
| Acrylic synthetic polymer latex having an average particle size of 50 nm (SX984A11: manufactured by Japan Synthetic Rubber Co., Ltd.) | 30 parts |
| Commercially available potassium oleate | 1 part |

Coating of a gloss-providing layer

A gloss-providing layer was formed by the modified re-wet method of the present invention. The coating composition for the gloss-providing layer was coated on the ink-receiving layer formed as described above by means of an air knife coater at a coating speed of 50 m/min, and the surface of the gloss-providing layer was solidified by using an infrared dryer. Then, water was supplied to the gloss-providing layer, and after 5 seconds, it was press-contacted to a heated specular roll having a surface temperature of 110° C. and dried, to obtain an ink jet recording sheet, Example 71. The dry coated amount of the gloss-providing layer was 10 g/m$^2$.

EXAMPLE 72

An ink-receiving layer was formed on a support in the same manner as in Example 71.

An ink jet recording sheet, Example 72 was formed in the same manner as in Example 71 except that 100 parts of colloidal silica (PST-1: manufactured by NISSAN CHEMICAL INDUSTRIES, LTD.) were used in the coating composition for the gloss-providing layer, instead of acrylic organic particles having an average particle size of 60 nm and colloidal silica having an average particle size of 40 nm.

EXAMPLE 73

An ink-receiving layer was formed on a support in the same manner as in Example 71.

The same coating composition for a gloss-providing layer as in Example 71 was coated, and the surface of the gloss-providing layer was solidified by using an infrared dryer. Then, water was supplied to the gloss-providing layer, and after 3 seconds, it was press-contacted to a heated specular roll having a surface temperature of 110° C. and dried, to obtain an ink jet recording sheet, Example 73.

The ink jet recording sheets thus obtained in Examples 71 to 73 were evaluated, and the results of the evaluation were shown in the following Table 15. The time in Table 15 means the time from the supply of water till the press-contacting a specular roll.

TABLE 15

| Example or Comparative Example | Method for surface finish of gloss-providing layer | Time | Releas-ability | 75° Specular gloss (%) | Ink absorp-tivity |
|---|---|---|---|---|---|
| Example 71 | Modified re-wet method | 5 | ○ | 75 | A |
| Example 72 | Modified re-wet method | 5 | ○ | 72 | A |
| Example 73 | Modified re-wet method | 3 | ○ | 80 | A |

From Table 15, it is clear that the ink jet recording sheets, Examples 71 and 72, which were prepared by successively laminating an ink-receiving layer and a gloss-providing layer containing colloidal particles having an average particle size of at most 300 nm on a support, solidifying the surface of the gloss-providing layer by using an infrared dryer, the re-wetting it, and press-contacting it to a heated specular roll to dry it, have high gloss comparable to commercially available cast coated paper and good ink absorptivities.

The ink jet recording sheet of the present invention comprises a support, at least one ink-receiving layer formed on the support, and a gloss-providing layer formed on the ink-receiving layer, and is excellent in ink absorptivity and capable of presenting a high printed image density, and has a high glossiness comparable to commercially available art coated paper. Further, the ink jet recording sheet of the present invention has folding strength in addition to these characteristics.

We claim:

1. An ink jet recording sheet comprising a support, at least one ink-receiving layer in an amount of at least 1 g/m$^2$ formed on the support, and a gloss-providing layer formed on the ink-receiving layer, said ink-receiving layer consisting essentially of a pigment and a binder, and said gloss-providing layer consisting essentially of a pigment and a synthetic polymer formed from a latex as binder and having a glossy surface with a 75° specular gloss of at least 25% as stipulated in JIS Z 8741, wherein at least 70 parts by weight in 100 parts by weight of the pigment in the gloss-providing layer are constituted by colloidal particles having an average particle size of at most 300 nm.

2. The ink jet recording sheet according to claim 1, wherein at least 90 parts by weight in 100 parts by weight of the pigment in the gloss-providing layer are constituted by the colloidal particles.

3. The ink jet recording sheet according to claim 2, wherein the pigment in the gloss-providing layer is entirely constituted by the colloidal particles.

4. The ink jet recording sheet according to claim 1, wherein the colloidal particles have an average particle size of at most 100 nm.

5. The ink jet recording sheet according to claim 1, wherein the colloidal particles are at least one member selected from the group consisting of colloidal silica, polystyrene organic particles, porous amorphous silica.alumina and acrylic organic particles.

6. The ink jet recording sheet according to claim 5, wherein the colloidal particles are cationic colloidal particles.

7. The ink jet recording sheet according to claim 5, wherein the colloidal particles comprise organic particles and colloidal silica in an organic particle/colloidal silica weight ratio of from 40/60 to 90/10.

8. The ink jet recording sheet according to claim 1, wherein the binder for the gloss-providing layer is a synthetic polymer formed from a latex having an average particle size of at most 150 nm.

9. The ink jet recording sheet according to claim 8, wherein the average particle size of the synthetic polymer formed from a latex is at most 100 nm.

10. The ink jet recording sheet according to claim 8, wherein the glass transition temperature of the synthetic polymer formed from a latex is at most +30° C.

11. The ink jet recording sheet according to claim 1, wherein the binder for the gloss-providing layer is a colloidal silica composite emulsion.

12. The ink jet recording sheet according to claim 1, wherein the gloss-providing layer contains an ampholite.

13. The ink jet recording sheet according to claim 1, wherein the gloss-providing layer contains smectite in an amount of from 0.5 to 10 parts by weight per 100 parts by weight of the colloidal particles.

14. The ink jet recording sheet according to claim 1, wherein the pigment in the ink-receiving layer adjacent to the gloss-providing layer is a pigment having at least 30 vol % of particles having a particle size of at most 1.0 μm.

15. The ink jet recording sheet according to claim 1, wherein the pigment in the ink-receiving layer adjacent to the gloss-providing layer is cationic colloidal particles.

16. The ink jet recording sheet according to claim 1, wherein the ink-receiving layer adjacent to the gloss-providing layer contains a cationic fixing agent.

17. The ink jet recording sheet according to claim 1, wherein the 75° specular gloss, as stipulated in JIS-Z8741, of the gloss-providing layer is at least 40%.

18. The ink jet recording sheet according to claim 17, wherein the 75° specular gloss, as stipulated in JIS-Z8741, of the gloss-providing layer is at least 55%.

19. The ink jet recording sheet according to claim 18, wherein the 75° specular gloss, as stipulated in JIS-Z8741, of the gloss-providing layer is at least 70%.

20. The ink jet recording sheet according to claim 19, wherein the 75° specular gloss, as stipulated in JIS-Z8741, of the gloss-providing layer is at least 80%.

* * * * *